US005307122A

United States Patent [19]

Ohno et al.

[11] Patent Number: 5,307,122

[45] Date of Patent: Apr. 26, 1994

[54] IMAGE FORMING APPARATUS APPARATUS UNIT FACSIMILE APPARATUS AND DEVELOPER COMPRISING HYDROPHOBIC SILICA FINE POWDER FOR DEVELOPING ELECTROSTATIC IMAGES

[75] Inventors: Manabu Ohno; Hisayuki Ochi; Tetsuhito Kuwashima; Hiroyuki Suematsu, all of Yokohama; Eiichi Imai, Narashino; Tsuyoshi Takiguchi, Yokohama; Koichi Tomiyama, Kawasaki; Tsutomu Kukimoto, Tokyo; Hiroshi Yusa, Yokohama, all of Japan

[73] Assignee: Canon Kabushiki Kaisha, Tokyo, Japan

[21] Appl. No.: 558,097

[22] Filed: Jul. 26, 1990

[30] Foreign Application Priority Data

| | | | |
|---|---|---|---|
| Jul. 28, 1989 | [JP] | Japan | 1-194015 |
| Jul. 28, 1989 | [JP] | Japan | 1-194016 |
| Jul. 28, 1989 | [JP] | Japan | 1-194026 |
| Jul. 28, 1989 | [JP] | Japan | 1-194028 |
| Dec. 22, 1989 | [JP] | Japan | 1-331299 |

[51] Int. Cl.[5] ..... G03G 15/08

[52] U.S. Cl. ..... 355/245; 355/219; 430/111; 430/106.6

[58] Field of Search ..... 355/219, 202, 211, 245, 355/251, 252, 253; 358/401; 430/107, 111, 106.6

[56] References Cited

U.S. PATENT DOCUMENTS

| | | | |
|---|---|---|---|
| 4,400,739 | 8/1983 | Landa | 358/293 |
| 4,414,579 | 11/1983 | Dattilo et al. | 358/300 |
| 4,470,689 | 9/1984 | Nomura et al. | 355/71 |

(List continued on next page.)

FOREIGN PATENT DOCUMENTS

| | | | |
|---|---|---|---|
| 280542 | 8/1988 | European Pat. Off. . | |
| 395026 | 10/1990 | European Pat. Off. . | |
| 46-5782 | 12/1971 | Japan | 103/K11Z |
| 48-47345 | 7/1973 | Japan | 103/K11Z |
| 48-47346 | 7/1973 | Japan | 103/K11Z |
| 50-13661 | 5/1975 | Japan | G03G 15/02 |
| 54-42141 | 4/1979 | Japan | G03G 13/08 |
| 55-18656 | 2/1980 | Japan | G03G 13/08 |
| 60-186854 | 9/1985 | Japan | G03G 9/08 |
| 1112253 | 4/1989 | Japan | G03G 9/08 |

OTHER PUBLICATIONS

Patent Abstracts of Japan, vol. 10, No. 382 [P-529] (2439) Dec. 20, 1986.

Patent Abstracts of Japan, vol. 9, No. 109 [P-355] (1832) May 14, 1985.

Patent Abstracts of Japan, vol. 7, No. 176 [P-214] (1321) Aug. 4, 1983.

Patent Abstracts of Japan, vol. 11, No. 12 [P-535] (2459) Jan. 13, 1987.

Patent Abstracts of Japan, vol. 9, No. 48 [P-338] (1771) Feb. 28, 1985.

*Primary Examiner*—R. L. Moses

*Attorney, Agent, or Firm*—Fitzpatrick, Cella, Harper & Scinto

[57] ABSTRACT

An image forming apparatus includes a member to be charged for carrying an electrostatic image, a contact-charging means for charging the member to be charged in contact with the member to be charged, and a developing means for developing the electrostatic image carried on the member to be charged. The developing means includes a developer for developing the electrostatic image comprising a toner and hydrophobic inorganic fine powder. The hydrophobic inorganic fine powder not only improves the fluidity of the developer and adjusts the chargeability of the developer but also prevents difficulties due to interaction between the member to be charged and the contact charging means in the presence of residual developer, such as damages of the member to be charged and toner-sticking onto the member to be charged.

75 Claims, 4 Drawing Sheets

U.S. PATENT DOCUMENTS

| | | | |
|---|---|---|---|
| 4,663,263 | 5/1987 | Ikeda et al. | 430/110 |
| 4,680,245 | 7/1987 | Suematsu et al. | 430/110 |
| 4,702,986 | 10/1987 | Imai et al. | 430/120 |
| 4,737,432 | 4/1988 | Tanaka et al. | 430/110 |
| 4,740,443 | 4/1988 | Nakahara et al. | 430/106.6 |
| 4,741,984 | 5/1988 | Imai et al. | 430/106.6 |
| 4,754,300 | 6/1988 | Fukae | 355/202 |
| 4,797,344 | 1/1989 | Nakahara et al. | 430/138 |
| 4,849,785 | 7/1989 | Tanabe | 355/202 |
| 4,868,084 | 9/1989 | Uchide et al. | 430/110 |
| 4,906,548 | 3/1990 | Uchide et al. | 430/126 |
| 4,939,060 | 7/1990 | Tomiyama et al. | 430/106.6 |
| 4,959,688 | 9/1990 | Koitabeshi et al. | 355/219 |
| 4,959,731 | 9/1990 | Fukae | 355/202 |
| 4,967,231 | 10/1990 | Hosoya et al. | 355/219 |
| 4,980,256 | 12/1990 | Kato et al. | 430/106.6 |
| 5,006,902 | 4/1991 | Araya | 355/219 X |
| 5,055,879 | 10/1991 | Bhagat | 355/219 |

IMAGE FORMING APPARATUS APPARATUS UNIT FACSIMILE APPARATUS AND DEVELOPER COMPRISING HYDROPHOBIC SILICA FINE POWDER FOR DEVELOPING ELECTROSTATIC IMAGES

FIELD OF THE INVENTION AND RELATED ART

The present invention relates to an image forming apparatus according to electrophotography and a developer therefor.

More particularly, the present invention relates to an image forming apparatus including a charging means for charging a member to be charged by causing a charging member supplied with a voltage from an external supply to contact the member to be charged and to a developer suitably used in the image forming apparatus.

Hitherto, a corona discharger has been used as a charging means in electrophotographic apparatus. The corona discharger involves a problem that it requires application of a high voltage to generate a large amount of ozone.

Recently, it has been studied to use a contact charging means instead of a corona discharger. More specifically, it has been proposed to cause a conductive roller as a charging means to contact a member to be charged such as a photosensitive member while applying a voltage to the conductive roller thereby to charge the member to be charged to a prescribed surface potential. By using such a contact charging means, it becomes possible to use a lower voltage than by a corona discharger thereby to decrease the generation of ozone.

For example, Japanese Patent Publication JP-B Sho 50-13661 discloses the use of a roller comprising a core metal coated with a dielectric of nylon or polyurethane rubber to charge a photosensitive paper by application of a low voltage.

In the above embodiment, however, the roller comprising a core metal coated with nylon lacks a resilience like that of rubber so that it can fail to maintain a sufficient contact with the member to be charged, thus providing an insufficient charge. On the other hand, in a roller comprising a core metal coated with polyurethane rubber, a softening agent impregnating the rubber gradually exudes out so that, if the member to be charged is a photosensitive member, the charging member is liable to stick to the photosensitive member at the abutting part when the photosensitive member is stopped or the photosensitive member is liable to cause fading of images at the abutting part. Further, if the softening agent in the rubber material constituting the charging member exudes out to stick to the photosensitive member surface, the photosensitive member is caused to have a lower resistivity to cause image flow and even becomes inoperable or causes sticking of a residual toner on the photosensitive member onto the surface of the charging member, thus leading to filming. If a large amount of toner sticks to the surface of the charging member, the surface of the charging member locally loses its chargeability to charge the photosensitive member surface ununiformly, thus adversely affecting the resultant toner images. This is because the residual toner is strongly pushed by the charging member against the photosensitive member surface, so that the residual toner is liable to stick to the surfaces of the charging member and the photosensitive member to mar or scratch the photosensitive member surface.

In a contact charging apparatus, the charging member is supplied with a DC voltage or a DC voltage superposed with an AC voltage. In this instance, in the region or therearound of contact between the charging member and the photosensitive drum, there frequently occur abnormal charging and repetitive flying of residual toner particles having a small diameter and a small weight. Accordingly, the residual toner is liable to be electrostatically adsorbed by or embedded in the surfaces of the charging member and photosensitive drum. This is very different from a case where a non-contact charging means is used as in a conventional corona discharger.

On the other hand, there have been used small-sized and inexpensive copying machines for personal use and laser beam printers in recent years. In these small-sized apparatus, it is desirable to use a cartridge integrally including a photosensitive member, a developing means, a cleaning means, etc., so as to provide a maintenance-free system. It is also desirable to use a single-component, dry, magnetic developer so as to simplify the structure of the developing means.

The processes using magnetic toners may for example include: the magne-dry process using an electro-conductive toner disclosed in U.S. Pat. No. 3,909,258, a process utilizing dielectric polarization of toner particles; a process utilizing charge transfer by agitation with a toner; developing processes wherein toner particles are caused to jump onto latent images as disclosed in JP-A 54-42141 and JP-A 55-18656; etc.

In order to form visible images of good image quality in such processes using a dry magnetic developer, the developer is required to have a high fluidity and a uniform chargeability, so that it has been conventionally practiced to add silicic acid fine powder to toner particles. Silicic acid fine powder (i.e., silica powder) per se is hydrophilic, so that a developer containing the silica added thereto agglomerates due to moisture in the air to lower its fluidity or even lower its chargeability due to moisture absorption by the silica. For this reason, it has been proposed to use hydrophobicity-imparted silica powder by JP-A 46-5782, JP-A 48-47345, JP-A 48-47346, etc. More specifically, there has been used hydrophobic silica obtained, e.g., by reacting silica powder with an organic silicon compound, such as dimethyldichlorosilane, to substitute an organic group for silanol groups on the surfaces of the silica particles.

In a magnetic toner, the magnetic toner per se shows an abrasive function. In an image forming step wherein a developer is pressed against a photosensitive member having a low surface-hardness such as an organic photoconductor (OPC) member, if the developer comprises a mixture of a magnetic toner and inorganic fine powder, several difficulties are liable to be encountered, such as white dropout in developed images due to scraping of the surfaces of both the pressing member and the photosensitive member, damages of the pressing member and photosensitive member, and soiling or contamination of the photosensitive member, such as melt-sticking and filming of the toner.

It has been proposed to add polymer particles smaller than toner particles by JP-A 60-186854, etc. When we prepared a developer according to such teaching, the resultant developer was not effective against toner sticking but was liable to cause charge irregularity in a contact charging apparatus.

On the other hand, in accordance with remarkable increases in capacity of host computers, a laser beam printer showing a high printing speed has been required. Further, an image forming apparatus free from ozone generation is desired in respect of an office environmental condition.

In contact charging, an increased voltage and an increased AC frequency are required so as to stably charge the photosensitive member in accordance with a process speed, which also promotes sticking of the developer onto the photosensitive member.

In recent years, severer requirements have been imposed on image qualities, and it is required to visualize even an extremely fine latent image faithfully without resolving failure such as solidification or discontinuity. Accordingly, there is a trend to use a smaller particle size of toner. For example, JP-A Hei 1-112253 has proposed a developer having a volume-average particle size of 4–9 microns.

A decrease in particle size of toner is generally accompanied with an increase in specific surface area thereof, so that such a toner is liable to soil or contaminate the pressing member and photosensitive member and also requires a larger amount of inorganic fine powder so as to ensure a sufficient fluidity in compensation for the increase in agglomeration characteristic. As a result, there is a tendency to promote image defects, such as white dropout due to abrasion of the pressing member and photosensitive member, and sticking and filming of toner due to damages of the pressing member and photosensitive member.

SUMMARY OF THE INVENTION

An object of the present invention is to provide an image forming apparatus and a developer for developing electrostatic images which is free from toner sticking or only accompanied with suppressed toner sticking, if any.

An object of the present invention is to provide an image forming apparatus and a developer providing toner images which show a high density and are free from fog.

An object of the present invention is to provide an image forming apparatus and a developer which hardly contaminate a contact charging apparatus.

An object of the present invention is to provide an image forming apparatus wherein charge irregularities onto a photosensitive member by a contact charging means are suppressed.

An object of the present invention is to provide a developer which can stably form visible images which are faithful to latent images, sharp and of high densities.

An object of the present invention is to provide a practical image forming apparatus including a contact charging means and a developing means for effecting development with the developer by the present invention.

According to the present invention, there is provided an image forming apparatus, comprising:

a member to be charged for carrying an electrostatic image, a contact-charging means for charging the member to be charged in contact with the member to be charged, and a developing means for developing the electrostatic image carried on the member to be charged, wherein the developing means includes a developer for developing the electrostatic image comprising a toner and hydrophobic inorganic fine powder.

According to another aspect of the present invention, there is provided a developer for developing electrostatic latent images, comprising:

a magnetic toner having a volume-average particle size of 4–8 microns and hydrophobic inorganic fine powder treated with silicone oil or silicone varnish;

wherein 100 wt. parts of the developer contains 0.2–2.0 wt. parts of the hydrophobic inorganic fine powder, and the magnetic toner contains a binder resin which comprises 3–20 wt. parts of polymerized units of a monomer having an acid group formed of a carboxyl group or its anhydride per 100 wt. parts of the binder resin and has an acid value of 1–70, and the developer has a BET specific surface area of 1.8–3.5 $m^2/g$, a loose apparent density of 0.4–0.52 $g/cm^3$, and a true density of 1.45–1.8 $g/cm^3$.

According to a further aspect of the present invention, there is provided an apparatus unit comprising:

a member to be charged for carrying an electrostatic image, a contact-charging means for charging the member to be charged in contact with the member to be charged, and a developing means for developing the electrostatic image carried on the member to be charged, wherein the developing means includes a developer for developing the electrostatic image comprising a toner and hydrophobic inorganic fine powder;

wherein at least one of said contact-charging means and developing means is supported integrally together with said member to be charged to form a single unit, which can be connected to or released from an apparatus body as desired.

According to another aspect of the present invention, there is provided a facsimile apparatus, comprising: an electrophotographic apparatus and a receiving means for receiving image data from a remote terminal, wherein said electrophotographic apparatus comprises:

a member to be charged for carrying an electrostatic image, a contact-charging means for charging the member to be charged in contact with the member to be charged, and a developing means for developing the electrostatic image carried on the member to be charged, wherein the developing means includes a developer for developing the electrostatic image comprising a toner and hydrophobic inorganic fine powder.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
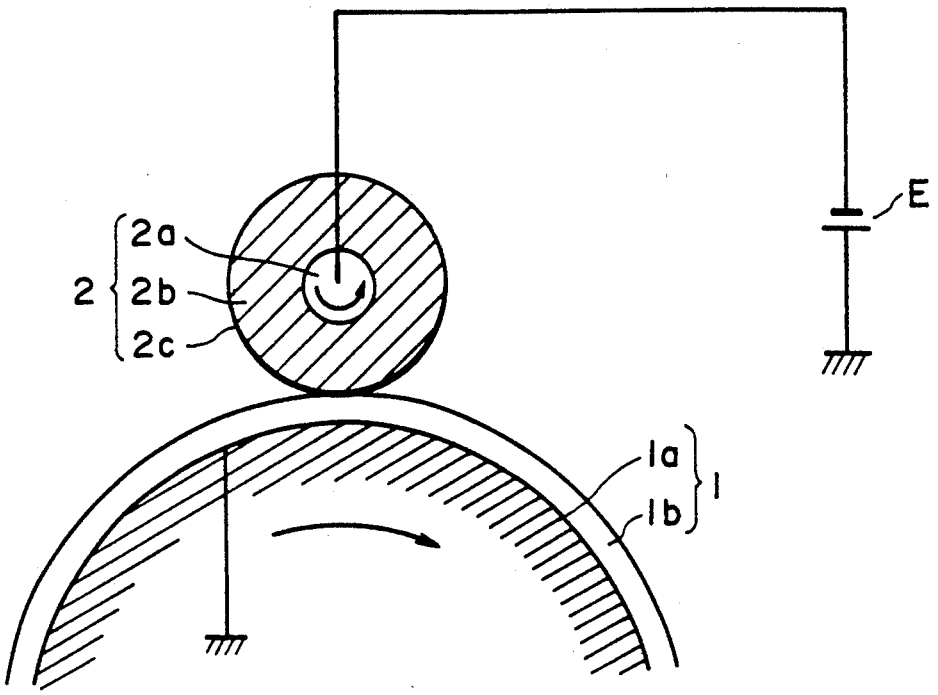
FIGS. 1 and 4 illustrate a contact-charging roller used in the image forming apparatus in the present invention.

The toner contained in the developer of the present invention may preferably have a volume-average particle size of 3-20 microns, particularly 4-15 microns.

In case where the toner is a magnetic toner, it is preferred that the magnetic toner has a volume-average particle size of 4-8 microns, particularly 6-8 microns, so as to provide a developer having a good resolution and causing little fog. The developer containing the magnetic toner may further preferably have a BET specific surface area of 1.8-3.5 $m^2/g$, a loose apparent density (or aerated bulk density) of 0.4-0.52 $g/cm^3$ and a true density of 1.45-1.8 $g/cm^3$ so as to provide a good resolution and cause little fog.

A developer having a BET specific surface area of 1.8-3.5 $m^2/g$ as measured by nitrogen adsorption shows an excellent performance from an early stage of operation, an excellent developer utilization efficiency and also a toner sticking-prevention effect onto the photosensitive member.

The developer of the present invention may preferably have a true density of 1.45-1.8 $g/cm^3$. In this range, the developer provides an appropriate application amount onto a latent image to provide a faithful, high-density image without thickening or thinning relative to the latent image. A true density of below 1.45 is liable to cause contamination in the apparatus due to scattering of the developer, toner-sticking onto the photosensitive member and increased fog.

The developer of the present invention may have a loose apparent density of 0.4-0.52 $g/cm^3$, which is characteristically small compared with the magnitude of the true density. The porosity calculated from the true density and the loose apparent density according to the following equation may preferably be 62-75%.

$$\text{Porosity } (\epsilon a) = [(\text{true density}) - (\text{apparent density})]/[\text{true density}] \times 100\ (\%)$$

The developer may preferably have a packed apparent density of 0.8-1.0 which may provide a porosity ($\epsilon p$) of 40-50%.

The developer satisfying the above properties does not cause plugging in the developing apparatus but may ensure a smooth supply to the developing zone, so that images showing a stable density can be always formed without white dropout. Further, the toner does not cause leakage, scattering or denaturation even after a large number of printing tests but can prevent toner-sticking onto the photosensitive member.

The BET specific surface area of the magnetic developer may be measured according to the BET one-point method by using a specific surface area meter (Autosorb 1, available from QUANTACHROME Co.).

The loose apparent density (or aerated bulk density) and packed apparent (or bulk) density referred to herein are based on the values measured by using Powder Test and the accompanying vessel (available from Hosokawa Micron K.K.) and according to the handling manual for the Powder Tester.

The true density referred to herein is based on values measured according to the following method which may be an accurate and convenient method for fine powder.

A stainless steel cylinder having an inner diameter of 10 mm and a length of about 50 cm, a disk (A) having an outer diameter of about 10 mm and a height of 5 mm, and a piston (B) having an outer diameter of about 10 mm and a length of about 8 cm which can be inserted into the cylinder in a close fitting, are provided. The disk (A) is placed at the bottom of the cylinder, about 1 g of a sample powder is placed thereon, and the piston (B) is gently pushed against the sample. Then, a pressure of 400 $kg/cm^2$ is applied to the piston by an oil press. After compression for 5 minutes, the compressed sample is taken out and weighed (W g), and the diameter (D cm) and height (L cm) of the compressed sample are measured by a micrometer caliper, whereby the true density is calculated according to the following equation:

$$\text{True density } (g/cm^3) = W/[\pi x (D/2)^2 x L]$$

The magnetic toner used in the present invention may preferably have a volume-average particle size of 4-8 microns, particularly, 6-8 microns, and such a particle size distribution including 17-60% by number of magnetic toner particles of 5 microns or smaller, 5-50% by number of magnetic toner particles of 6.35-10.08 microns and 2.0 volume % or less of magnetic toner particles of 12.7 microns or larger and further satisfying the following equation:

$$N/V = -0.05N + k.$$

wherein N denotes the contents in % by number of the magnetic toner particles of 5 microns or smaller, V denotes the content in % by volume of the magnetic toner particles of 5 microns or smaller, k is a positive number of 4.6-6.7, and N is a positive number of 17-60.

If the volume-average particle size of the magnetic toner is below 4 microns, the toner coverage on a transfer paper becomes small to result in a low image density for a usage having a large image area such as a graphic image. This may be attributable to the same reason why the image density of an inner image portion becomes lower than that at the contour or edge portion of the image as all be described hereinafter. Further, a volume-average particle size of below 4 microns is liable to result in toner-sticking onto the photosensitive member.

If the volume-average particle size of the magnetic toner is above 8 microns, the resolution is lowered to cause a lower image quality in a successive copying. If the content of magnetic toner particles of 5 microns or smaller is below 17% by number, the amount of magnetic toner particles effective for a high image quality and particularly, as the printing out is continued, the amount of the effective magnetic toner particle component is decreased to cause a fluctuation in magnetic toner particle size distribution and gradually deteriorates the image quality. If the content is above 60% by number, mutual agglomeration of the magnetic toner particles is liable to occur to produce toner lumps having a larger size than the proper size, thus leading to difficulties, such as rough image quality, a low resolution, a large difference in density between the contour and interior of an image to provide a somewhat hollow image, and also toner-sticking onto the photosensitive member.

It is preferred that the content of the particles in the range of 6.35–10.08 microns is 5–50% by number, particularly 8–40% by number. Above 50% by number, the image quality becomes worse, and excess of toner coverage is liable to occur, thus resulting in a poor reproducibility of thin lines and an increased toner consumption. Below 5% by number, it is difficult to obtain a high image density. The contents of the magnetic toner particles of 5 microns or smaller in terms of % by number (N %) and % by volume (V %) may preferably satisfy the relationship of $N/V=-0.05N+k$, wherein k represents a positive number satisfying $4.6 \leqq k \leqq 6.7$. The number k may preferably satisfy $4.6 \leqq k \leqq 6.2$, more preferably $4.6 \leqq k \leqq 5.7$. Further, as described above, the percentage N satisfies $17 \leqq N \leqq 60$, preferably $25 \leqq N \leqq 50$, more preferably $30 \leqq N \leqq 60$.

If $k<4.6$, magnetic toner particles of 5.0 microns or below are insufficient, and the resultant image density, resolution and sharpness decrease. When fine toner particles in a magnetic toner, which have conventionally been considered useless, are present in an appropriate amount, they are effective for achieving closest packing of toner in development and contribute to the formation of a uniform image free of coarsening. Particularly, these particles fill thin-line portions and contour portions of an image, thereby to visually improve the sharpness thereof. If $k<4.6$ in the above formula, such component becomes insufficient in the particle size distribution, and the above-mentioned characteristics become poor.

Further, in view of the production process, a large amount of fine powder must be removed by classification in order to satisfy the condition of $k<4.6$. Such a process is however disadvantageous in yield and toner costs. On the other hand, if $k>6.7$, an excess of fine powder is present, whereby the resultant image density is liable to decrease in successive print-out. The reason for such a phenomenon may be considered that an excess of fine magnetic toner particles having an excess amount of charge are triboelectrically attached to a developing sleeve and prevent normal toner particles from being carried on the developing sleeve and being supplied with charge.

In the magnetic toner of the present invention, the amount of magnetic toner particles having a particle size of 12.7 microns or larger is 2.0 by volume or smaller, preferably 1.0% by volume or smaller, more preferably 0.5% by volume or smaller. If the above amount is larger than 2.0% by volume, these particles are liable to impair thin-line reproducibility.

The particle size distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner of the present invention may be obtained.

The toner contained in the developer according to the present invention may generally comprise a binder resin and a magnetic material or a colorant.

The binder for use in constituting the toner may be a known binder resin for toners. Examples thereof may include: polystyrene; homopolymers of styrene derivatives, such as poly-p-chlorostyrene, and polyvinyltoluene; styrene copolymers, such as styrene-propylene copolymer, styrene-vinyltoluene copolymer, styrene-vinylnaphthalene copolymer, styrene-methyl styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, styrene-maleic acid ester copolymer; polymethyl methacrylate, polybutyl methacrylate, polyvinyl acetate, polyethylene, polypropylene, polyvinyl butyral, polyacrylic acid resin, rosin, modified rosin, terpene resin, phenolic resin, aliphatic or alicyclic hydrocarbon resin, aromatic petroleum resin, paraffin wax, and carnauba wax. These resins may be used singly or in mixture.

The colorant which may be contained in the toner may be a pigment or dye, inclusive of carbon black and copper phthalocyanine, conventionally used.

Magnetic particles contained in the magnetic toner according to the present invention may comprise a material which may be magnetized in a magnetic field. Examples thereof may include: powder of ferromagnetic metal, such as iron, cobalt or nickel; or alloys or compounds, such as iron-based alloys, nickel-based alloys, magnetite, $\gamma$-$Fe_2O_3$ and ferrites.

The magnetic particles may preferably have a BET specific surface area as measured by nitrogen adsorption of 1–20 $m^2/g$, particularly 2.5–12 $m^2/g$ and Mohs' hardness of 5–7. The magnetic particles may be contained in a 10–70% by weight of the toner.

The magnetic toner may further preferably have a bulk density of 0.35 $g/cm^3$ or higher.

By satisfying the above properties, the developer according to the present invention hardly causes toner sticking onto the surface of the contact-charging member or photosensitive drum even when some developer remains on the photosensitive drum after the cleaning step.

For this reason, the developer according to the present invention may be extremely fit for the charging step used in the present invention, thus allowing the charging step to fully exhibit its performances to provide always good images.

We consider that the developer according to the present invention exhibits the above effects because magnetic particles are uniformly dispersed in the magnetic toner constituting the developer. If the uniform dispersion is not realized, a portion of the toner rich in magnetic material is caused to have a higher surface-exposure rate of the magnetic material and a lower elasticity because of a corresponding decrease of the binder resin, whereby a strong rubbing is caused between the surfaces of the contact-charging member and the photosensitive member at the abutting parts between these members due to mechanical pressure or electrical pressing force acting under DC or AC electric field through voltage application to the charging member, thus being liable to cause damage or abrasion. On the other hand, a portion of the toner rich in binder resin is caused to have a higher viscoelasticity due to a decrease in proportion of the magnetic material, so that spot or filmy sticking onto the surfaces of the charging member and the photosensitive drum is liable to occur.

The bulk density of the magnetic material may be understood to be an indirect measure of the agglomeration of the magnetic particles. If the bulk density of the magnetic material is below 0.35 g/cm$^3$, much agglomerate is present in the magnetic material so that it is difficult to accomplish a sufficient dispersibility in the binder resin. Thus, the magnetic material is liable to be localized to give scratches or abrasion at the surfaces of the contact charging member and the photosensitive member. Further, the sticking of the developer is liable to be caused at the abutting parts between these members. In order to accomplish good dispersion of the magnetic material in the developer, it is preferred to use a magnetic material having a bulk density of 0.35 g/cm$^3$ or higher, particularly 0.5 g/cm$^3$ or higher.

Herein, the bulk density of a magnetic material refers to a value measured according to JIS (Japanese Industrial Standards) K-5101.

The magnetic material contained in the developer according to the present invention may preferably have a coercive force of 100 oersted (Oe) or below, more preferably 80 oersted (Oe) or below, under a magnetic field of 10000 oersted (Oe). The coercive force of magnetic particles are generally controlled by their crystalline magnetic anisotropy and shape anisotropy and may be understood as an indirect measure of their surface shape. If a magnetic material has a larger crystallinity, the magnetic material is caused to have a larger coercive force and the particles thereof are caused to have sharp surface edges. If such magnetic particles having sharp surface edges are used in the present invention, they are liable to cause not only scratches or abrasion on the surfaces of the contact-charging member and the photosensitive drum but also sticking of the developer due to embedding at the abutting part between the members. Accordingly, it is preferred to lower the coercive force of the magnetic particles so as to provide smoothly curved surfaces. It is to be noted however that the coercive force can be lowered to below 100 Oe also when the magnetic particles are agglomerated, so that a bulk density of 0.35 g/cm$^3$ or below is preferred also in this case.

Further, the magnetic material used in the magnetic toner according to the present invention may preferably have a remanence ($\sigma_r$) of 10 emu/g or below, more preferably 7 emu/g or below, after application of a magnetic field of 10000 Oe. If the magnetic material has a remanence exceeding 10 emu/g, the particles thereof are liable to cause a larger degree of magnetic agglomeration and be present as agglomerates in the magnetic material. Such localization of the magnetic material is liable to promote the sticking of the developer onto the surfaces of the contact-charging member and the photosensitive member. Thus, a remanenace exceeding 10 emu/g is not preferred.

The magnetic properties of magnetic materials referred to herein are values measured by a tester ("VSMP-1") available from Toei Kogyo K.K.

The magnetic material used in the present invention may preferably be one obtained through a wet process using ferrus sulfate as a starting material and may preferably comprise magnetite or ferrite containing 0.1–10 wt. % of a divalent metal such as manganese or zinc.

The magnetic material may preferably be one which has been subjected to disintegration or milling as desired. Examples of means for disintegrating the magnetic material may include a mechanical pulverizer equipped with a high-speed rotor for disintegrating a powdery material and a pressure disperser equipped with a weight roller for disintegrating or milling a powdery material.

In case where a mechanical pulverizer is used for disintegrating agglomerates of magnetic particles, an excessive impact force by the rotor is liable to be applied even to primary particles of the magnetic particles so that even the primary particles are liable to be broken to yield fine powder of the magnetic particles. Accordingly, in the case where a magnetic material disintegrated by a mechanical pulverizer is used as a starting material of the toner, if such fine powder of the magnetic particles is contained in a large amount, the magnetic particle fine powder is likely to be exposed at the developer surface at a higher percentage to enhance the abrasive function of the developer, thus being deviated from the expected performance.

To the contrary, it is preferred to use a pressure disperser equipped with a weight roller, such as a fret mill, in view of the efficiency of disintegrating agglomerates of the magnetic particles and suppressed formation of fine powdery magnetic particles.

The toner used in the present invention may preferably be negatively chargeable and may contain a charge control agent, as desired, examples of which may include: metal complexes or salts of monoazo dyes, salicylic acid, alkylsalicylic acid, dialkylsalicylic acid, and naphthoic acid. The magnetic toner may preferably have a volume resistivity of $10^{10}$ ohm.cm or higher, particularly $10^{12}$ ohm.cm or higher in respects of triboelectric chargeability and electrostatic transfer characteristic. The volume resistivity referred to herein may be defined as a value obtained by molding a toner sample under a pressure of 100 kg/cm$^2$, applying an electric field of 100 V/cm and measuring a current value at a time one minute after the commencement of the application, whereby the volume resistivity is calculated based on the measured current value.

The toner-binder resin constituting the developer according to the present invention may particularly preferably be one containing 3–20 wt. parts of polymerized units of a monomer having a carboxylic group or an acid anhydride group derived therefrom per 100 wt. parts of the binder resin and having an acid value of 1–70.

The binder resin having an acid group may comprise various resins and may preferably be one containing a tetrahydrofuran (THF)-soluble content which has a weight-average molecular weight/number-average molecular weight ratio of 5 or larger ($Mw/Mn \geqq 5$) and also has a peak in the molecular weight range of from 2000 to below 15000, preferably 2000–10000 and a peak or shoulder in the molecular weight range of 15000–100,000 based on the molecular weight distribution by gel-permeation chromatography (GPC) of the THF-soluble content. This is because the THF-insoluble content principally affects the anti-offset characteristic and anti-winding characteristic, a component having a molecular weight of below 15,000, particularly 10,000 or below, principally affects the blocking, sticking onto the photosensitive member and filming, and a component having a molecular weight of 10,000 or above, particularly 15,000 or above, principally affects the fixing characteristic.

The binder resin (copolymer) having an acid group of carboxyl or its anhydride may be contained in either one or both of the above-mentioned two molecular weight regions.

The GPC (gel permeation chromatography) measurement and identification of molecular weight corresponding to the peaks and/or shoulders may be performed under the following conditions.

A column is stabilized in a heat chamber at 40° C., tetrahydrofuran (THP) solvent is caused to flow through the column at that temperature at a rate of 1 ml/min., and 50–200 μl of a sample resin solution in THF at a concentration of 0.05–0.6 wt. % is injected. The identification of sample molecular weight and its molecular weight distribution is performed based on a calibration curve obtained by using several monodisperse polystyrenedisperse samples and having a logarithmic scale of molecular weight versus count number. The standard polystyrene samples for preparation of a calibration curve may be those having molecular weights of, e.g., $6\times10^2$, $2.1\times10^3$, $4\times10^3$, $1.75\times10^4$, $1\times10^4$, $1.1\times10^5$, $3.9\times10^5$, $8.6\times10^5$, $2\times10^6$ and $4.48\times10^6$ available from, e.g., Pressure Chemical Co. or Toyo Soda Kogyo K.K. It is appropriate to use at least 10 standard polystyrene samples. The detector may be an RI (refractive index) detector.

For accurate measurement of molecular weights in the range of $10^3$–$4\times10^6$, it is appropriate to constitute the column as a combination of several commercially available polystyrene gel columns. A preferred example thereof may be a combination of μ-styragel 500, $10^3$, $10^4$ and $10^5$ available from Waters Co.; a combination of Shodex KF-80M, 802, 803, 804 and 805, or a combination of TSK gel G1000H, G2000H, G2500H, G3000H, G4000H, G5000H, G6000H, G7000H and GMH available from Toyo Soda K.K.

The content of a component having a molecular weight of 10,000 or below in the binder resin is measured by cutting out a chromatogram of the corresponding molecular weight portion and calculating a ratio of the weight thereof with that of the chromatogram covering the molecular weight range of 10,000 or higher, to derive the weight % thereof in the whole binder resin.

Examples of the polymerizable monomer having an acid group which may be used in the present invention may include; α,β-unsaturated carboxylic acids, such as acrylic acid and methacrylic acid; α,β-unsaturated dicarboxylic acids and half esters thereof, such as maleic acid, butyl maleate, octyl maleate, fumaric acid and butyl fumarate; and alkenyldicarboxylic acids or half esters thereof, such as n-butenylsuccinic acid, n-octenylsuccinic acid, butyl n-butenylsuccinate, n-butenylmalonic acid and n-butenyladipic acid.

In this case, it is preferred that the content of the polymerizable monomer unit in the whole binder resin may preferably be in a proportion of 3–30 wt. %, and the binder resin as a whole has an acid value of 1–70, further preferably 5–50.

The acid values referred to herein are based on values measured as follows according to JIS K-0670.

2–10 g of a sample resin is weighed in a 200–300 ml-Erlenmeyer flask, and about 50 ml of a solvent mixture of ethanol/benzene (=1/2) to dissolve the resin. If the solubility is insufficient, a small amount of acetone may be added. The solution is titrated with a N/10-caustic potassium solution in ethanol, which has been standardized in advance, in the presence of a phenolphthalein indicator, whereby the acid value (mgKOH/g) of the sample resin is calculated from the consumed amount of the caustic potassium solution according to the following equation (3):

$$\text{Acid value} = \text{Amount of KOH solution (ml)} \times N \times 56.1/\text{sample weight} \quad (3)$$

wherein N denotes the number of factor for the N/10 KOH.

Examples of the comonomer for providing the binder resin having an acid group through copolymerization with the polymerizable monomer having an acid group may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-hexylstyrene, p-n-octylstyrene, p-n-onylstyrene, p-n-decylstyrene, and p-n-dodecylstyrene; ethylenically unsaturated monoolefins, such as ethylene, propylene, butylene, and isobutylene; unsaturated polyenes, such as butadiene; vinyl halides, such as vinyl chloride, vinylidene chloride, vinyl bromide, and vinyl fluoride; vinyl esters, such as vinyl acetate, vinyl propionate, and vinyl benzoate; α-methylene-aliphatic monocarboxylic acid esters, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinylpyrrolidone; and derivatives acrylic acid and methacrylic acid, such as acrylonitrile, methacrylonitrile and acrylamide.

These vinyl monomers may be used singly or in mixture of two or more species in combination with the above-mentioned monomer having an acid group.

Among the above, a monomer combination providing a styrene copolymer or a styrene-(meth)acrylate copolymer is particularly preferred.

A crosslinking monomer, e.g., one having at least two polymerizable double bonds, may also be used.

Thus, the vinyl copolymer used in the present invention may preferably be a crosslinked polymer with a crosslinking monomer as follows:

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.).

Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01-5 wt. parts, particularly about 0.03-3 wt. parts, per 100 wt. parts of the other monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

The binder resin according to the present invention may suitably be prepared through a process for synthesizing two or more polymers or copolymers.

For example, a first polymer or copolymer soluble in THF and also in a polymerizable monomer is dissolved in such a polymerizable monomer, and the monomer is polymerized to form a second polymer or copolymer, thus providing a resin composition comprising a uniform mixture of the first polymer or copolymer and the second polymer or copolymer.

The first polymer or copolymer may preferably be formed through solution polymerization or ionic polymerization. The second polymer or copolymer providing a THF-insoluble content may preferably be prepared through suspension polymerization or bulk polymerization of a monomer dissolving the first polymer or copolymer in the presence of a crosslinking monomer. It is preferred that the first polymer or copolymer is used in a proportion of 10-120 wt. parts, particularly 20-100 wt. parts, per 100 wt. parts of the polymerizable monomer giving the second polymer or copolymer.

The solvent used in the solution polymerization may be xylene, toluene, cumene, acid cellosolve, isopropyl alcohol, benzene, etc. In case of a styrene monomer, xylene, toluene or cumene may be preferred. The solvent may be selected depending on the product polymer. Further, an initiator, such as di-tert-butyl peroxide, tert-butyl peroxybenzoate, benzoyl peroxide, 2,2'-azobisisobutyronitrile, 2,2'-azobis(2,4-dimethylvaleronitrile), etc., may be used in a proportion of 0.1 wt. part or more, preferably 0.4-15 wt. parts, per 100 wt. parts of the monomer. The reaction temperature may vary depending on the solvent, initiator, monomers, etc., to be used but may suitably be in the range of 70-180° C. In the solution polymerization, the monomer may be used in an amount of 30-400 wt. parts per 100 wt. parts of the solvent.

Further, the binder resin used in the present invention may preferably contain 10-70 wt. % of a THF (tetrahydrofuran)-insoluble content. If the THF-insoluble content is below 10 wt. %, the resultant toner is liable to stick to the contact-charging member. If the THF-insoluble content exceeds 70 wt. the toner per se is caused to have too large a rigidity so that the surface of the latent image-bearing member or the contact-charging member is liable to be damaged to possibly increase the tendency of toner-sticking.

Herein, the THF-soluble content refers to a polymer component (substantially a crosslinked polymer component) which is insoluble in solvent THF (tetrahydrofuran) in the resin composition (binder resin) constituting a toner, and it may be used as a parameter for indicating the degree of crosslinking of the resin composition containing a crosslinked component. It is to be noted however that a polymer having a low degree of crosslinking can be soluble in THF. For example, a crosslinked polymer obtained through solution polymerization can be THF-soluble even if it has been obtained in the presence of a relatively large amount of crosslinking agent such as divinylbenzene. The THF-insoluble content may be defined as a value obtained in the following manner.

0.5-1.0 g of a toner sample is weighed ($W_1$g) and placed in a cylindrical filter paper (e.g., No. 86R available from Toyo Roshi K.K.) and then subjected to extraction with 100 to 200 ml of solvent extraction by using a Soxhlet's extractor for 6 hours. The soluble content extracted with the solvent THF is recovered by evaporation and dried for several hours at 100° C. under vacuum to measure a weight ($W_2$g) of the THF-soluble content. On the other hand, the weight ($W_3$g) of the components, such as the magnetic material and/or pigment, other than the resin component in the toner is separately measured. Then, the THF-insoluble content is given by the following equation:

THF-insoluble content $$[W_1-(W_2+W_3)]/[W_1-W_3]\times 100$$

The developer according to the present invention contains a hydrophobic inorganic fine powder as an additive, which may preferably be a hydrophobic metal oxide fine powder, further preferably hydrophobic silicic acid (silica) fine powder.

Among the above-mentioned inorganic powders, those having a specific surface area as measured by the BET method with nitrogen adsorption of 70-300 $m^2/g$, provide a good result. In the present invention, a hydrophobic silica fine powder may preferably be used in an amount of 0.1-3.0 wt. parts, more preferably 0.2-2.0 wt. parts, with respect to 100 wt. parts of the toner.

It is preferred to use negatively chargeable hydrophobic silica fine powder for a negatively chargeable toner. The hydrophobic silica fine powder may preferably be one having a triboelectric charge of $-100$ $\mu C/g$ to $-300$ $\mu C/g$. When the silica fine powder having a triboelectric charge below $-100$ $\mu C/g$ is used, it tends to decrease the triboelectric charge of the developer per se, whereby humidity characteristic becomes poor.

When silica fine powder having a triboelectric charge of above −300 μC/g is used, it tends to promote a so-called "memory phenomenon" on a developer-carrying member and the developer may easily be affected by deterioration of the silica, whereby durability characteristic may be impaired. When the silica is too fine so that its BET specific surface area is above 300 $m^2/g$, the addition thereof produces little effect. When the silica is too coarse so that its BET specific surface area is below 70 $m^2/g$, the probability of free powder presence is increased, whereby the dispersion thereof in the toner is liable to be ununiform. In such a case, black spots due to silica agglomerates are liable to occur.

The hydrophobicity-imparting treatment may be effected by using a known agent and a known method. The hydrophobicity-imparting agent may for example be a silane coupling agent, or a silicon oil or silicone varnish. A silicone oil or silicone varnish may be preferred to a silane coupling agent in respects of hydrophobicity and lubricity.

The silicone oil or silicone varnish preferably used in the present invention may be those represented by the following formula:

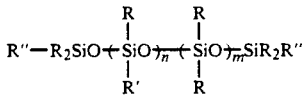

wherein R: a $C_1$–$C_3$ alkyl group, R′: a silicone oil-modifying group, such as alkyl, halogen-modified alkyl, phenyl, and modified-phenyl, R″: a $C_1$–$C_3$ alkyl or alkoxy group.

Specific examples thereof may include: dimethylsilicone oil, alkyl-modified silicone oil, α-methylstyrene-modified silicone oil, chlorophenyl-silicone oil, and fluoro-modified silicone oil. The above silicone oil may preferably have a viscosity at 25° C. of about 50–1000 centi-stokes. A silicon oil having too low a molecular weight can generate a volatile matter under heating, while one having too high a molecular weight has too high a viscosity leading to a difficulty in handling.

In order to treat the silica fine powder with silicone oil, there may be used a method wherein silica fine powder treated with a silane coupling agent is directly mixed with a silicone oil by means of a mixer such as Henschel mixer; a method wherein a silicone oil is sprayed on silica as a base material; or a method wherein a silicone oil is dissolved or dispersed in an appropriate solvent, the resultant liquid is mixed with silica as a base material, and then the solvent is removed to form a hydrophobic silica.

It is further preferred to treat the inorganic fine powder first with a silicone oil or silicone varnish.

When the inorganic fine powder is treated only with a silicone oil, a large amount of silicone oil is required, so that the fine powder can agglomerate to provide a developer with a poor fluidity and the treatment with a silicone oil must be carefully performed. However, if the fine powder is first treated with a silane coupling agent and then with a silicone oil, the fine powder is provided with a good moisture resistance while preventing agglomeration of the powder and thus the treatment effect with a silicone oil can be sufficiently exhibited.

The silane coupling agent used in the present invention may be hexamethyldisilazane or those represented by the formula: $R_mSiY_n$, wherein R: an alkoxy group or chlorine atom, m: an integer of 1–3, Y: alkyl group, vinyl group, glycidoxy group, methacryl group or other hydrocarbon groups, and n: an integer of 3–1. Specific examples thereof may include: dimethyldichlorosilane, trimethylchlorosilane, allyldimethylchlorosilane, allylphenyldichlorosilane, benzyldimethylchlorosilane, vinyltriethoxysilane, γ-methaceryloxypropyltrimethoxysilane, vinyltriacetoxysilane, divinylchlorosilane, and dimethylvinylchlorosilane.

The treatment of the fine powder with a silane coupling agent may be performed in a dry process wherein the fine powder is agitated to form a cloud with which a vaporized or sprayed silane coupling agent is reacted, or in a wet process wherein the fine powder is dispersed in a solvent into which a silane coupling agent is added dropwised to be reacted with the fine powder.

The silicone oil or silicone varnish may be used in an amount 1–35 wt. parts, preferably 2–30 wt. parts, to treat 100 wt. parts of the inorganic fine powder. If the amount of the silicone oil or silicone varnish is too small, it is possible that the moisture resistance is not improved to fail to provide high quality copy images. If the silicon oil or silicone varnish is too much, the inorganic fine powder is liable to agglomerate and even result in free silicone oil or silicone varnish, thus leading to failure in improving the fluidity of the developer.

An amino-modified silicone oil or varnish may also be used to treat the inorganic fine powder. Examples thereof may include those represented by the following formula (I):

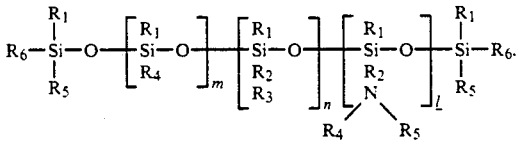

(I)

wherein $R_1$ and $R_6$ respectively denote hydrogen, alkyl group, aryl group or alkoxy group; $R_2$ denotes alkylene group or phenylene group; $R_3$ denotes a nitrogen-containing heterocyclic group; and $R_4$ and $R_5$ respectively denote hydrogen, alkyl group or aryl group. $R_2$ can be omitted. The above-mentioned alkyl group, aryl group, alkylene group or phenylene group can have an amino-substituent and can have a substituent, such as halogen, within an extent not adversely affecting the chargeability. In the above formula, m is a number of 1 or larger, n and 1 are respectively 0 or a positive number with a proviso that n+1 is a positive number of 1 or larger.

Among the compounds represented by the above formula, those having one or two nitrogen atoms in side chains are most preferred.

Many of nitrogen-containing unsaturated heterocyclic rings have been known including the following examples.

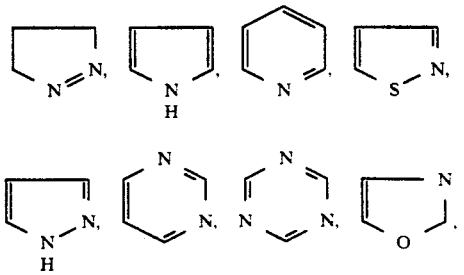

-continued

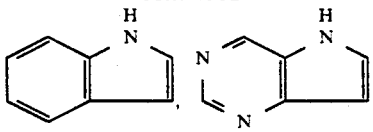

Further, examples of nitrogen-containing saturated heterocyclic rings may include the following:

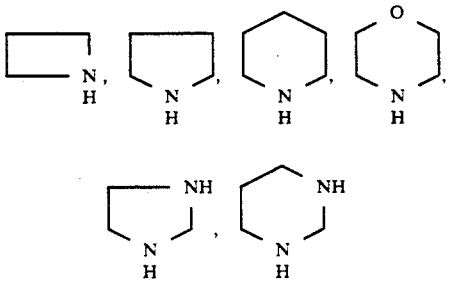

It is preferred to use 5-membered or 6-membered heterocyclic group while other groups can also be used in addition to those derived from the above-enumerated heterocyclic rings.

Derivatives from the above-mentioned silicone compounds can also be used inclusive of those including a substituent, such as hydrocarbon group, halogen group and a known other group, such as vinyl group, mercapto group, methacryl group, glycidoxy group, and ureido group.

It is preferred that the silicone oil used in the present invention has a nitrogen atom equivalent of 10,000 or below, further preferably 300–2000. Herein, the nitrogen atom equivalent refers to an equivalent (g. equiv.) per nitrogen atom which is obtained by dividing the molecular weight of a silicone oil by the number of nitrogen atoms in one molecule of the silicone oil. The nitrogen atom equivalent can also be used for a single species of silicone oil or a mixture of two or more species of silicone oil.

The treatment with a silicone oil may be effected according to a known technique. For example, the fine powder may be mixed with a mixer, an amino-modified silicone oil is sprayed into the fine powder by means of a sprayer, or the fine powder is mixed with a solution of an amino-modified silicone oil, followed by removal of the solvent by evaporation.

The fine powder can also be treated with an amino-modified silicone varnish which has been obtained from a silicone oil such as, methylsilicone varnish, phenylmethylsilicone varnish. Methylsilicone varnish is particularly preferred.

Methylsilicone varnish is a polymer comprising a $T^{31}$ unit, a $D^{31}$ unit and an $M^{31}$ unit as shown below, and more specifically, is a tridimensional polymer containing a large proportion of the $T^{31}$ unit.

[$T^{31}$ unit]

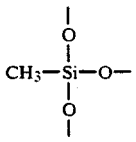

-continued

[$D^{31}$ unit]

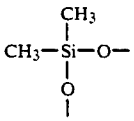

[$M^{31}$ unit]

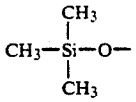

The above-mentioned silicone varnish may be converted into an amino-modified silicone varnish by replacing a part of the methyl group or phenyl group in the $T^{31}$ unit, $D^{31}$ unit and $M^{31}$ unit with an amino group-containing group. Examples of the amino group-containing group may include those represented by the following structural formulas:

$$-CH_2CH_2-NH_2$$

$$-CH_2(CH_2)_2-NH_2$$

$$-CH_2(CH_2)_2-NH-(CH_2)_3-NH_2$$

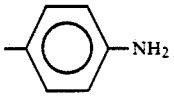

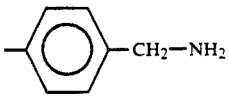

The treatment of the fine powder with the silicone varnish may be effected in a known manner similarly as the treatment with the silicone oil.

100 wt. parts of the inorganic fine powder may be treated with 3–50 wt. parts, preferably 5–40 wt. parts, of the solid content of the amino-modified silicone oil or amino-modified silicone varnish. Below 3 wt. parts, the surfaces of the inorganic fine powder cannot be sufficiently covered thus resulting in little improvement in anti-moisture characteristic. Above 50 wt. parts, the inorganic fine powder is liable to cause agglomeration to result in insufficient dispersion in the toner.

The triboelectric charge of silica fine powder may be measured in the following manner.

0.2 g of silica fine powder which has been left to stand overnight in an environment of 23.5° C. and relative humidity of 60% RH, and 9.8 g of carrier iron powder not coated with a resin having a mode particle size of 200 to 300 mesh (e.g. EFV 200/300, produced by Nippon Teppun K.K.) are mixed thoroughly in an aluminum pot having a volume of about 50 cc in the same environment as mentioned above (by shaking the pot in hands vertically about 50 times for about 20 sec).

Figure 3:
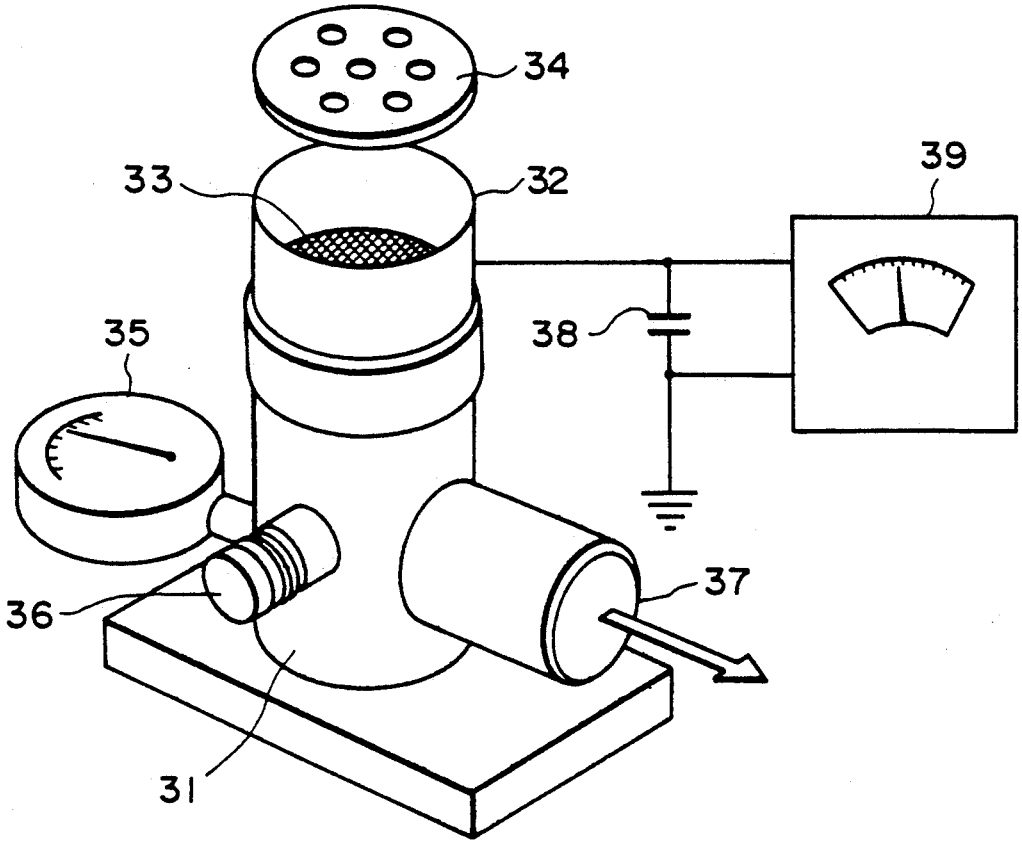
FIG. 3 is an illustration of an instrument for measuring triboelectric charges.

Then, about 0.5 g of the shaken mixture is charged in a metal container 32 for measurement provided with 400-mesh screen 33 at the bottom as shown in FIG. 3 and covered with a metal lid 34. The total weight of the container 32 is weighed and denoted by $W_1$ (g). Then, an aspirator 31 composed of an insulating material at least with respect to a part contacting the container 32 is operated, and the silica in the container is removed by suction through a suction port 37 sufficiently while controlling the pressure at a vacuum gauge 35 at 250 mmhg by adjusting an aspiration control valve 36. The reading at this time of a potential meter 39 connected to the container by the medium of a capacitor having a capacitance C ($\mu$F) is denoted by V (volts.). The total weight of the container after the aspiration is measured and denoted by $W_2$ (g). Then, the triboelectric charge ($\mu$C/g) of the silica is calculated as: $CxV/(W_1-W_2)$.

The fine silica powder used in the present invention can be either the so-called "dry process silica" or "fumed silica" which can be obtained by oxidation of gaseous silicon halide, or the so-called "wet process silica" which can be produced from water glass, etc. Among these, the dry process silica is preferred to the wet process silica because the amount of the silanol group present on the surfaces or in interior of the particles is small and it is free from production residue such as $Na_2O$, $SO_3^{2-}$.

The dry process silica referred to herein can include a complex fine powder of silica and another metal oxide as obtained by using another metal halide, such as aluminum chloride or titanium chloride together with a silicon halide.

The silica powder may preferably have an average primary particle size in the range of 0.001–2 microns, particularly 0.002–0.2 micron.

In the present invention, the hydrophobicity of the silica fine powder may be measured in the following manner, while another method can be applied with reference to the following method.

A sample in an amount of 0.1 g is placed in a 200 ml-separating funnel equipped with a sealing stopper, and 100 ml of ion-exchanged water is added thereto. The mixture is shaken for 10 min. by a Turbula Shaker Mixer model T2C at a rate of 90 r.p.m. The separating funnel is then allowed to stand still for 10 min. so that a silica powder layer and an aqueous layer are separated from each other, and 20– 30 ml of the content is withdrawn from the bottom. A portion of the water is taken in a 10 mm-cell and the transmittance of the thus withdrawn water is measured by a colorimeter (wavelength: 500 nm) in comparison with ion-exchanged water as a blank containing no silica fine powder. The transmittance of the water sample is denoted as the hydrophobility of the silica.

The hydrophobic silica used in the present invention should preferably have a hydrophobicity of 60 or higher, particularly 90% or higher. If the hydrophobicity is below 60%, high-quality images cannot be attained because of moisture absorption by the silica fine powder under a high-humidity condition.

To the developer according to the present invention, it is possible to further incorporate other additives within an extent not giving ill effects, which may for example include a fixing aid, such as low-molecular weight polyethylene, and a metal oxide such as tin oxide as a chargeability-imparting agent.

The toner used in the present invention may be prepared by a method in which toner constituents are kneaded well in a hot kneading means, such as a kneader or extruder, mechanically crushed and classified; a method wherein a binder resin solution containing other components dispersed therein is spray-dried; a polymerization method wherein prescribed ingredients are dispersed in a monomer constituting a binder resin and the mixture is emulsified, followed by polymerization of the monomer to provide a polymer; etc.

Hereinbelow, a contact-charging step applicable to the developer and the image forming method according to the present invention will be explained more specifically.

FIG. 1 is a schematic illustration of a contact-charging apparatus as an embodiment of the invention. The apparatus includes a photosensitive drum 1 as a member to be charged which comprises an aluminum drum substrate 1*a* and an OPC (organic photoconductor) layer 1*b* coating the outer surface of the drum 1*a* and rotates at a prescribed speed in a direction of an arrow. In this embodiment, the photosensitive drum 1 has an outer diameter of 30 mm. The apparatus further includes a charging roller 2 as a charging means which contacts the photosensitive drum 1 at a prescribed pressure. The charging roller 2 comprises a metal core 2*a*, an electroconductive rubber roller 2*b* and a surface layer 2*c* having a releasable film. The electroconductive rubber layer 2*b* may suitably have a thickness of 0.5–10 mm, preferably 1–10 mm. The surface layer comprising a film with a releasability is preferred in respect of compatibility with the developer and the image forming method according to the present invention. If the releasable film has too high a resistivity, the photosensitive drum cannot be charged but, if the resistivity is too small, an excessively large voltage is applied to the photosensitive drum, so that it is preferred for the releasable film to have an appropriate resistivity value, preferably a volume resistivity of $10^9$–$10^{14}$ ohm.m. The releasable film may preferably have a film thickness of 30 microns or below, particularly 10–30 microns. The lower limit in thickness of the releasable film may be determined so as not to cause peeling or tearing and may be about 5 microns.

Figure 4:
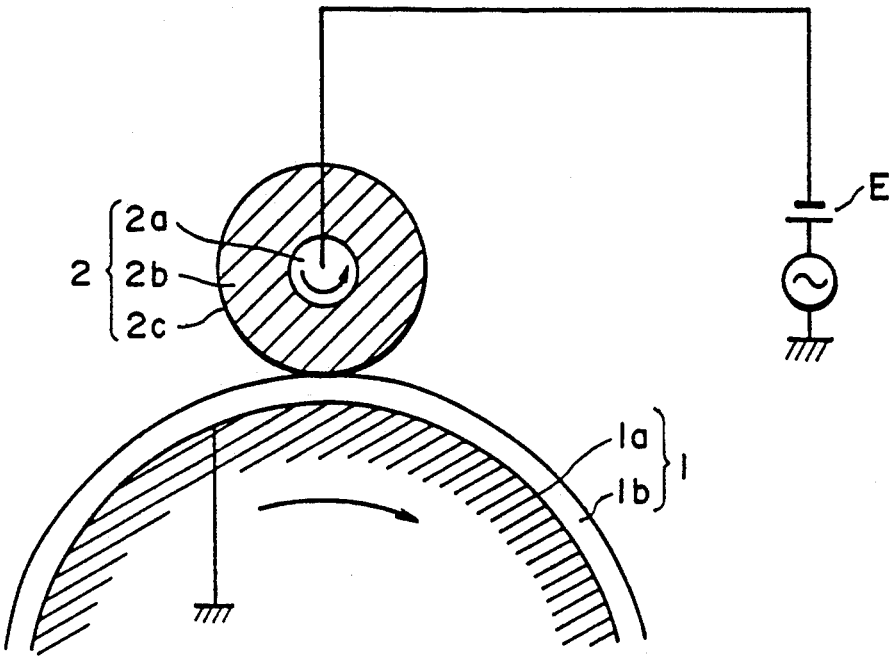

In this embodiment, the charging roller 2 has an outer diameter of 12 mm and includes an about 3.5 mm-thick electroconductive rubber layer 2*b* of ethylene-propylene-diene terpolymer and 10 micron-thick surface layer 2*c* of a nylon resin (more specifically, methoxymethylated nylon). The charging roller 2 has a hardness of 54.5 degrees (ASKER-C). A prescribed voltage is supplied to the core metal 2*a* (diameter=5 mm) of the charging roller 2 from a power supply E. FIG. 1 shows that a DC voltage is supplied from E but a DC voltage superposed with an Al voltage as shown in FIG. 4 is rather preferred.

It is preferred to disperse electroconductive fine powder such as carbon in the electroconductive rubber layer or/and the releasable film so as to adjust the resistivity.

Preferred process conditions in this embodiment may be as follows.

Abutting pressure: 5–500 g/cm
AC voltage: 0.5–5 kVpp
AC frequency: 50–3000 Hz
DC voltage (absolute value): 200 to 900 V.

Figure 2:
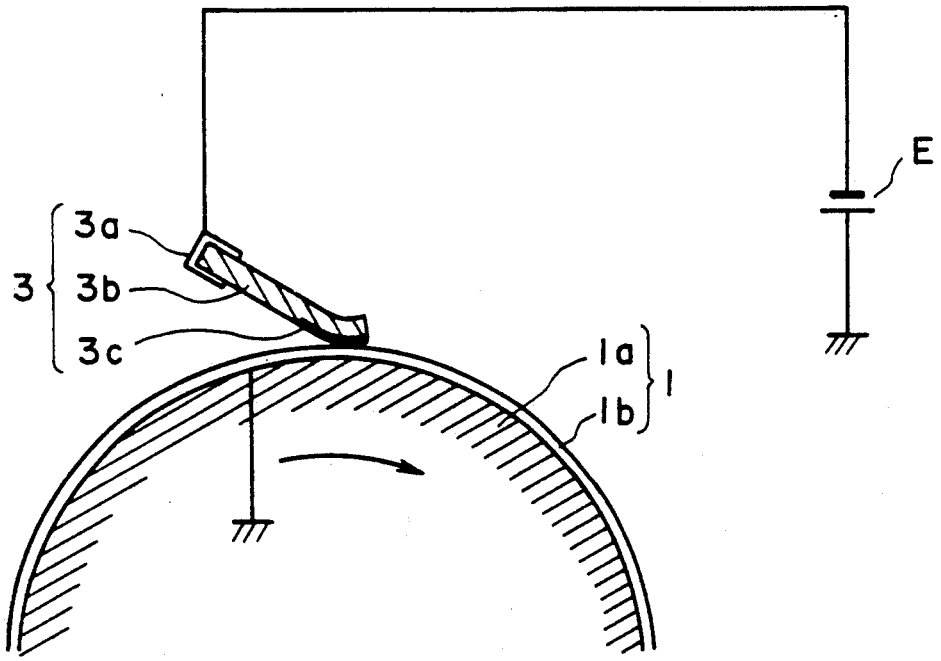
FIG. 2 is an illustration of a contact-charging blade as another embodiment of the contact-charging means.

FIG. 2 is an illustration of a contact-charging means according to another embodiment of the present invention, wherein like reference numerals are used to denote like member as used in FIG. 1, the explanation of which is omitted here.

A contact-charging member 3 in this embodiment is in the form of a blade abutted at a prescribed pressure against a photosensitive member 1 in a forward direction as shown. The blade 3 comprises a metal support 3*a* to which a voltage is supplied and on which an electroconductive rubber piece 3*b* is supported. Further, the portion abutting or contacting a photosensitive drum is provided with a surface layer 3c comprising a releasable film. In a specific embodiment, the surface layer 3c comprised 10 micron-thick nylon. According to this embodiment, a difficulty such as sticking between the blade and the photosensitive member is not encountered to show a similar performance as in the previous embodiment.

In the above-embodiment, charging members in the form of a roller and a blade have been explained, but the shape is not restricted as such and other shapes can also be used.

In the above embodiments, the charging member comprises an electroconductive rubber layer and a releasable film but this is not necessary. Further, it is preferred to insert a high resistance layer for preventing leakage, such as a hydrin rubber layer having a good environmental stability between the conductive rubber layer and the releasable film surface layer.

It is possible to use a releasable film of polyvinylidene fluoride (PVDF) or polyvinylidene chloride (PVDC) instead of nylon resin. The photosensitive member may also comprise amorphous silicon, selenium, ZnO, etc., in addition to an OPC photosensitive member. Particularly, in the case of using a photosensitive member of amorphous silicon, image flow becomes noticeable when even a small amount of a softening agent from the conductive layer attaches to the photosensitive member compared with a case of using another photosensitive member, the coating of the conductive rubber layer with an insulating film becomes remarkably effective.

In the cleaning step according to the present invention, the photosensitive drum after toner image transfer is wiped by a cleaning member such as a cleaning blade or roller for removal of the transfer residue toner or other contaminants thereon to be cleaned and repetitively subjected to image formation. The cleaning blade or roller may preferably comprise polyurethane or silicone resin.

Such a cleaning step can also be effected simultaneously as the charging step, developing step or transfer step.

The present invention is particularly effective when applied to an image forming apparatus equipped with a latent image-bearing member (a member to be charged) which is surfaced with an organic compound. In case where the surface layer is formed of an organic compound, a binder resin in the toner and the surface layer are likely to adhere to each other and toner sticking is liable to occur at the contacting point especially when similar materials are used.

The surfacing material for the latent image bearing member used in the present invention may comprise, e.g., silicone resins, vinylidene chloride resins, ethylene-vinyl chloride resin, styreneacrylonitrile resin, styrene-methyl methacrylate resin, styrene resins, polyethylene terephthalate resins and polycarbonate resins, but can comprise another material, such as copolymers of or with other monomers, copolymers between above enumerated components and polymer blends without being restricted to the above. Among these, polycarbonate resins are particularly preferred.

The present invention is particularly effective when applied to an image forming apparatus using a latent image-bearing member having a diameter of 50 mm or smaller. In such a small-sized drum, an identical linear pressure can produce a concentration of stress at the abutting point because of a large curvature.

A similar phenomenon may be encountered also in case of a belt photosensitive member, and accordingly the present invention is also effective to an image forming apparatus using a photosensitive member having a radius of curvature of 25 mm or smaller at the transfer zone.

Figure 5:
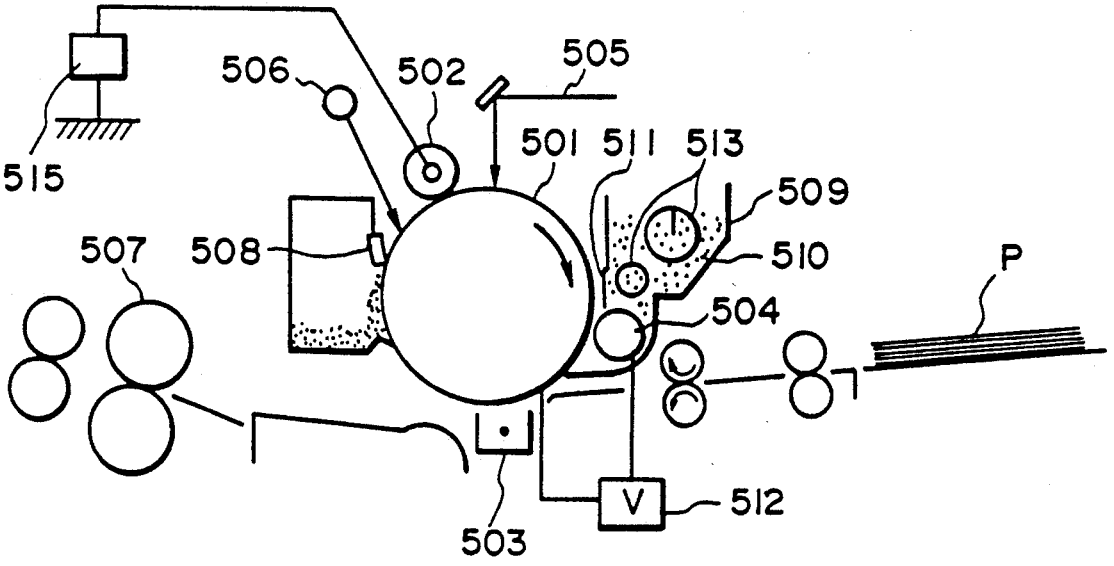
FIG. 5 is a schematic illustration of an embodiment of the image forming apparatus according to the present invention.

Referring to FIG. 5, the image forming method and image forming apparatus according to the present invention are explained.

A photosensitive member 501 surface is negatively charged by a contact charger 502 connected to a voltage application means 515, subjected to image-scanning with laser light 505 to form a digital latent image, and the resultant latent image is reversely developed with a negatively chargeable monocomponent magnetic developer 510 in a developing vessel 509 equipped with a magnetic blade 511 and a developing sleeve 514 containing a magnet therein. In the developing zone, an alternating bias, pulse bias and/or DC bias is applied between the conductive substrate of the photosensitive drum 501 and the developing sleeve 504 by a bias voltage application means. When a transfer paper P is conveyed to a transfer zone, the paper is charged from the back side (opposite side with respect to the photosensitive drum), whereby the developed image (toner image) on the photosensitive drum is electrostatically transferred to the transfer paper P. Then, the transfer paper P is separated from the photosensitive drum 501 and subjected to fixation by means of a hot pressing roller fixer 507 for fixing the toner image on the transfer paper P.

Residual monocomponent developer remaining on the photosensitive drum after the transfer step is removed by a cleaner 508 having a cleaning blade. The photosensitive drum 501 after the cleaning is subjected to erase-exposure for discharge and then subjected to a repeating cycle commencing from the charging step by the charger 502.

The electrostatic image-bearing member (photosensitive drum) comprises a photosensitive layer and a conductive substrate and rotates in the direction of the arrow. The developing sleeve 504 comprising a non-magnetic cylinder as a toner-carrying member rotates so as to move in the same direction as the electrostatic image holding member surface at the developing zone. Inside the non-magnetic cylinder sleeve 504, a multi-pole permanent magnet (magnet roll) as a magnetic field generating means is disposed so as not to rotate. The monocomponent insulating magnetic developer 510 stirred by a stirrer 513 in the developing vessel 509 is applied onto the non-magnetic cylinder sleeve 504 and the toner particles are provided with, e.g., a negative triboelectric charge due to friction between the sleeve 504 surface and the toner particles. Further, the magnetic doctor blade 511 of iron is disposed adjacent to the cylinder surface (with a spacing of 50–500 microns) and opposite to one magnetic pole of the multi-pole permanent magnet, whereby the thickness of the developer layer is regulated at a thin and uniform thickness (30–300 microns) which is thinner than the spacing between the electrostatic image bearing member 501 and the toner carrying member 504 so that the developer layer does not contact the image bearing member 501. The revolution speed of the toner carrying member 504 is so adjusted that the circumferential velocity of the sleeve 504 is substantially equal to or close to that of the electrostatic image bearing member 501. It is possible to constitute the magnetic doctor blade 511 with a permanent magnet instead of iron so as to form a counter magnetic pole. In the developing zone, an AC bias or a pulsed bias may be applied between the toner carrying member 504 and the electrostatic image bearing surface by the biasing means 512. The AC bias may comprise f=200-4000 Hz and Vpp=500-3000 V.

In the developing zone, the toner particles are transferred to the electrostatic image under the action of an electrostatic force exerted by the electrostatic image bearing surface and the AC bias or pulsed bias.

It is also possible to use an elastic blade of an elastic material, such as silicone rubber, instead of the magnetic iron blade, so as to apply the developer onto the developer carrying member and regulate the developer layer thickness by a pressing force exerted by the elastic blade.

In the electrophotographic apparatus, plural members inclusive of some of the above-mentioned members such as the photosensitive member, developing means and cleaning means can be integrally combined to form an apparatus unit so that the unit can be connected to or released from the apparatus body. For example, at least one of the charging means, developing means and cleaning means can be integrally combined with the photosensitive member to form a single unit so that it can be attached to or released from the apparatus body by means of a guide means such as a guide rail provided to the body.

Figure 6:
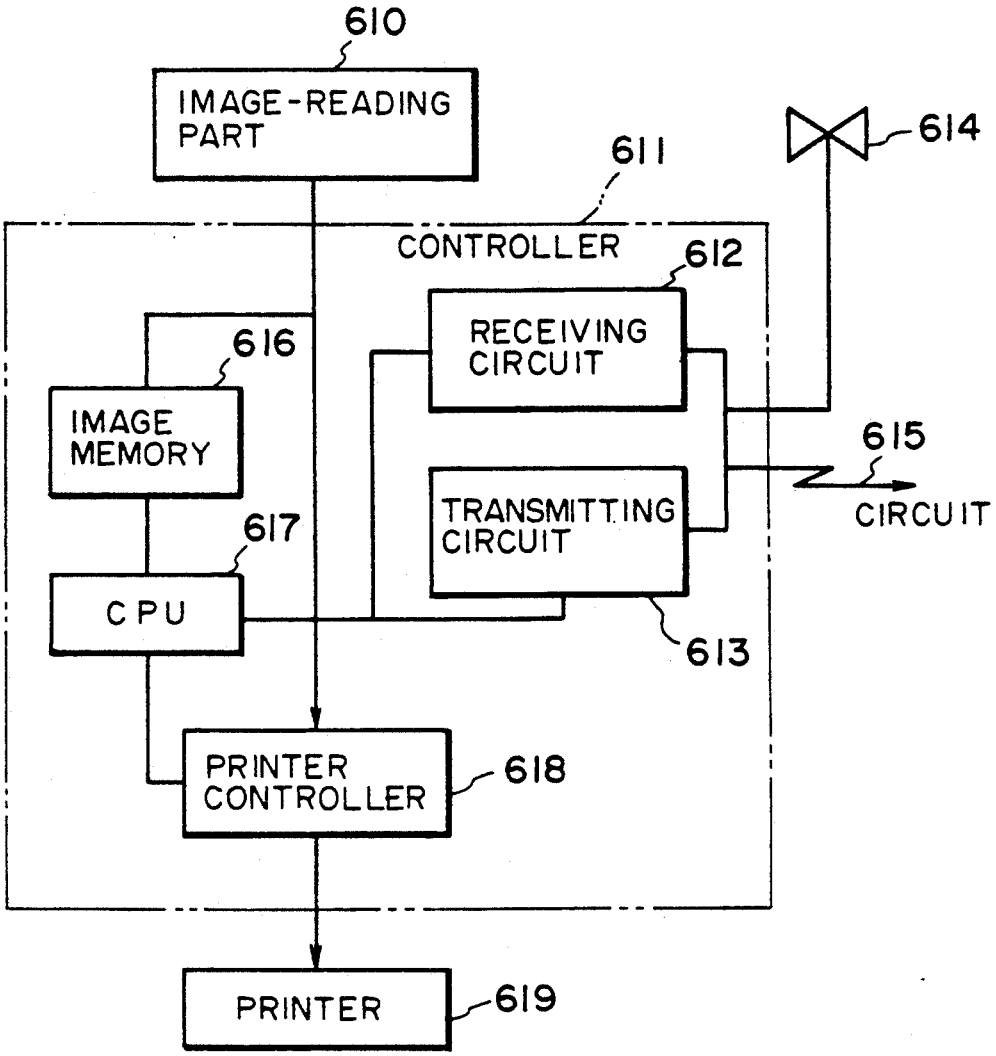
FIG. 6 is a block diagram showing a system constituting a facsimile apparatus.

In a case where the image forming apparatus according to the present invention is used as a printer for facsimile, the laser light 505 may be replaced by exposure light image for printing received data. FIG. 6 is a block diagram for illustrating such an embodiment.

Referring to FIG. 6, a controller 611 controls an image reader (or image reading unit) 610 and a printer 619. The entirety of the controller 611 is regulated by a CPU 617. Data read from the image reader 610 is transmitted through a transmitter circuit 613 to a remote terminal such as another facsimile machine. On the other hand, data received from a remote terminal is transmitted through a receiver circuit 612 to a printer 619. An image memory 616 stores prescribed image data. A printer controller 618 controls the printer 619. A telephone handset 614 is connected to the receiver circuit 612 and the transmitter circuit 613.

More specifically, an image received from a line (or circuit) 615 (i.e., image data received a remote terminal connected by the line) is demodulated by means of the receiver circuit 612, decoded by the CPU 617, and sequentially stored in the image memory 616. When image data corresponding to at least one page is stored in the image memory 616, image recording or output is effected with respect to the corresponding page. The CPU 617 reads image data corresponding to one page from the image memory 616, and transmits the decoded data corresponding to one page to the printer controller 618. When the printer controller 618 receives the image data corresponding to one page from the CPU 617, the printer controller 618 controls the printer 619 so that image data recording corresponding to the page is effected. During the recording by the printer 619, the CPU 617 receives another image data corresponding to the next page.

Thus, receiving and recording of an image may be effected.

The present invention will be explained in more detail with reference to Examples, by which the present invention is not limited at all. In the formulations appearing in the Examples, parts are parts by weight.

Synthesis Example 1

200 parts of cumene was charged in a reaction vessel and heated to a reflux temperature. Further, into the vessel, 85 parts of styrene monomer, 15 parts of acrylic acid monomer and 8.5 parts of di-tert-butyl peroxide were added. The solution polymerization was completed under refluxing of the cumene (146°-156° C.), followed by distilling-off of the cumene by raising the temperature. The resultant styrene-acrylic acid copolymer was soluble in THF and showed parameters: Mw (weight-average molecular weight)=3,500, Mw/Mn (weight-average molecular weight/number-average molecular weight)=2.52, the molecular weight at the main peak in the GPC chart=3,000, and Tg (glass transition point)=56° C.

30 parts of the above copolymer was dissolved in the following monomer mixture to form a mixture solution.

| [Monomer mixture] | |
|---|---|
| Styrene monomer | 50 parts |
| n-Butyl acrylate monomer | 17 parts |
| Acrylic acid monomer | 3 parts |
| Divinylbenzene | 0.26 part |
| Benzoyl peroxide | 1 part |
| tert-Butylperoxy-2-ethylhexanoate | 0.7 part |

To the above mixture solution was added 170 parts of water containing 0.1 part of incompletely saponified polyvinyl alcohol to form a liquid suspension. The suspension was added to a nitrogen-aerated reaction vessel containing 15 parts of water and subjected to 6 hours of suspension polymerization at 70°-95° C.

After the reaction, the product was recovered by filtration, de-watered and dried to form a copolymer composition. In the composition, styrene-acrylic acid copolymer and styrene-n-butyl acrylate copolymer were uniformly mixed. The THF-soluble content of the resin composition was subjected to measurement of molecular weight distribution by GPC to provide peaks at molecular weights of about 3500 and about 31000 in the GPC chart, Mn (number-average molecular weight)=5100, Mw=115000, Mw/Mn=22.5 and a content of molecular weight being 10000 or below of 27 wt. %. The resin showed a Tg of 59° C., and the content of molecular weight being 1000 or below isolated by GPC showed a glass transition point Tg1 of 57° C.

The resin composition showed an acid value of 22.0.

Synthesis Example 2

The following monomer mixture was subjected to solution polymerization in 200 parts of cumene at a cumene reflux temperature.

| [Monomer mixture] | |
|---|---|
| Styrene monomer | 90 parts |
| n-Butyl maleate (half ester) monomer | 10 parts |
| di-tert-Butyl peroxide | 8.5 parts |

After the reaction, cumene was removed by heating. The resultant styrene-n-butyl acrylate copolymer showed parameters: Mw=6,900, Mw/Mn=2.36, a main peak molecular-weight=7200 and Tg=64° C.

30 parts of the above styrene-n-butyl maleate (half ester) copolymer was dissolved in the following monomer mixture and subjected to polymerization in the same manner as in Synthesis Example 1 to form a resin composition comprising styrene-n-butyl maleate (half ester) copolymer and styrene-n-butyl acrylate-n-butyl maleate (half ester) copolymer. The resin composition showed an acid value of 20.6.

| [Monomer mixture] | |
|---|---|
| Styrene | 45 parts |
| n-Butyl acrylate | 20 parts |
| n-Butyl maleate (half ester) | 5 parts |
| Divinylbenzene | 0.25 part |
| Benzoyl peroxide | 0.65 part |
| tert-Butylperoxide-ethylhexanoate | 0.85 part |

Synthesis Example 3

200 parts of cumene was charged in a reaction vessel and heated to a reflux temperature. Into the vessel, a mixture of 78 parts of styrene, 15 parts of n-butyl acrylate, 7 parts of n-butyl maleate (half ester), 0.3 part of divinylbenzene and 1.0 part of di-tert-butyl peroxide was added dropwise in 4 hours under reflux of the cumene, followed by 4 hours of polymerization and removal of the solvent by ordinary distillation under reduced pressure to obtain a copolymer. The polymer showed: $Mw=25\times10^4$, $Mw/Mn=11.0$, $Tg=60^\circ$ C., and an acid value of 19.5.

Reference Synthesis Example 1

A copolymer was obtained in the same manner as in Synthesis Example 3 except that 82 parts of styrene and 18 parts of n-butyl acrylate were used and n-butyl maleate (half ester) was omitted. The copolymer showed an acid value of 0.4.

Synthesis Example 4

A copolymer was obtained in the same manner as in Synthesis Example 3 except that the amount of the styrene was changed to 82 parts and the amount of the n-butylmaleate (half ester) was changed to 3 parts. The copolymer showed an acid value of 7.3.

Synthesis Example 5

A copolymer was obtained in the same manner as in Synthesis Example 3 except that the amount of the styrene was changed to 70 parts and the amount of the n-butylmaleate (half ester) was changed to 15 parts. The copolymer showed an acid value of 48.

Synthesis Example 6

200 parts of cumene was charged in a reaction vessel and heated to a reflux temperature. Further, a mixture of 100 parts of styrene monomer and 7.8 parts of benzoyl peroxide was added dropwise thereto in 4 hours under reflux of the cumene. Further, the solution polymerization was completed under reflux of the cumene (146°-156° C.), followed by removal of the cumene. The resultant polystyrene was soluble in THF, showed a main peak at a molecular weight of 3,900 on the GPC chromatogram and showed a Tg of 58° C.

30 parts of the above polystyrene was dissolved in the following monomer mixture to form a mixture solution.

| (Monomer mixture) | |
|---|---|
| Styrene | 50 parts |
| n-Butyl acrylate | 20 parts |
| Divinylbenzene | 0.26 part |
| Benzoyl peroxide | 1.7 parts |

To the above mixture solution was added 170 parts of water containing 0.1 part of incompletely saponified polyvinyl alcohol to form a liquid suspension. The suspension was added to a nitrogen-aerated reaction vessel containing 15. parts of water and subjected to 6 hours of suspension polymerization at 70°-95° C. After the reaction, the product was recovered by filtration, dewatered and dried to obtain a composition comprising polystyrene and styrene-n-butyl acrylate copolymer. The composition was a uniform mixture of a THF-soluble content and a THF-insoluble content and was also a uniform mixture of polystyrene and styrene-n-butyl acrylate copolymer. The resin composition was recovered as a powder fraction of 24 mesh-pass and 60 mesh-on. About 0.5 g of the powder was accurately weighed and placed in a cylindrical filter paper with a diameter of 28 mm and a length of 100 mm (No. 86R, available from Toyo Roshi K.K.), and 200 ml of THF was refluxed at a rate of one time per about 4 min. to measure the THF-insoluble content as a portion remaining on the filter paper. The resin composition showed a THF-insoluble content of 32 wt. %. The THF-soluble content was subjected to measurement of molecular weight distribution, whereby the resultant GPC chart showed peaks at molecular weights of about 4,500 and about 45,000 and a content of molecular weight being 10,000 or below of 28 wt. The resin further showed a Tg of 60° C.

The parameters relating to the molecular weight of resins and resin compositions were measured in the following manner.

Shodex KF-80M (available from Showa Denko K.K.) was used as a GPC column and incorporated in a heat chamber held at 40° C. of a GPC measurement apparatus ("150C ALC/GPC", available from Waters Co.). The GPC measurement was effected by injecting 200 ul of a sample (a THF-soluble concentration of about 0.1 wt. into the column at a THF flow rate of 1 ml/min. and by using an RI (refractive index) detector. The calibration curve for molecular weight measurement was prepared by using THF solutions of 10 monodisperse polystyrene standard samples having molecular weights of $0.5\times10^3$, $2.35\times10^3$, $10.2\times10^3$, $35\times10^3$, $110\times10^3$, $200\times10^3$, $470\times10^3$, $1200\times10^3$, $2700\times10^3$ and $8420\times10^3$ (available from Waters Co.).

Synthesis Example 7

A production method similar to that in Synthesis Example 6 was effected except for adjusting the polymerization temperature to obtain a uniform mixture of polystyrene and styrene-n-butyl acrylate copolymer, which showed a THF-insoluble content of 12 wt. %, a Tg of 56° C. and included a THF-soluble content showing peaks at molecular weights of about 2,200 and about 19,000 and a molecular weight portion of 10,000 or below of 43 wt.

Synthesis Example 8

150 parts of cumene was charged in a reaction vessel and heated to a reflux temperature, and the following mixture was added dropwise thereto in 4 hours under reflux of the cumene.

| (Monomer mixture) | |
|---|---|
| Styrene | 98 parts |
| n-Butyl methacrylate | 2 parts |
| di-tert-Butyl peroxide | 4.2 parts |

Further, the polymerization was completed under reflux of cumene (146°-156° C.), followed by removal of the cumene. The resultant styrene-n-butyl methacrylate copolymer showed a main peak at molecular weight of 6,000 and a Tg of 64° C.

35 parts of the above styrene-n-butyl methacrylate copolymer was dissolved in the following monomer mixture to form a mixture solution.

| (Monomer mixture) | |
|---|---|
| Styrene | 35 parts |
| n-Butyl acrylate | 25 parts |
| Divinylbenzene | 0.25 part |
| Benzoyl peroxide | 1.5 part |

To the above mixture solution was added 170 parts of water containing 0.1 part of incompletely saponified polyvinyl alcohol to form a liquid suspension. The suspension was added to a nitrogen-aerated reaction vessel containing 15. parts of water and subjected to 6 hours of suspension polymerization at 70°-95° C. After the reaction, the product was recovered by filtration, dewatered and dried to obtain a composition comprising a uniform mixture of styrene-n-butyl methacrylate copolymer and styrene-n-butyl acrylate copolymer.

The resin composition showed a THF-insoluble content of 60 wt. %, and included a THF-soluble content showing peaks at molecular weights of about 6300 and about $8.0\times10^4$ on the GPC chart and a portion of molecular weight being 10,000 or below of 17 wt. The resin showed a Tg of 55° C.

Synthesis Example 2

A production method similar to that in Synthesis Example 7 was effected except that the polymerization temperature was adjusted to obtain a resin composition, which showed a THF-insoluble content of 6 wt. %, and included a THF-soluble content showing peaks at molecular weights of about 1800 and $1.5\times10^4$ on the GPC chart and a portion of molecular weight being 10,000 or below of 56 wt. The resin showed a Tg of 49° C.

Reference Synthesis Example 3

30 parts of the polystyrene prepared in Synthesis Example 6 was dissolved in the following monomer mixture to form a mixture solution.

| (Monomer mixture) | |
|---|---|
| Styrene | 55 parts |
| n-Butyl methacrylate | 15 parts |
| Divinylbenzene | 0.13 parts |
| t-Butyl peroxyhexanoate | 1.0 parts |

The above mixture solution was subjected to suspension polymerization similarly as in Synthesis Example 6 to obtain a composition comprising polystyrene and styrene-n-butyl methacrylate copolymer.

The resin composition showed a THF-insoluble content of 76 wt. %. and included a THF-soluble content showing peaks at molecular weights of about $1.0\times10^4$ and about $16\times10^4$ on the GPC chart and a portion of molecular weight being 10,000 or below of 7 wt. The resin showed a Tg of 60° C.

| Production Example 1 | |
|---|---|
| Resin composition of Synthesis Example 1 | 100 parts |
| Magnetic fine powder (BET value = 8.6 $m^2/g$) | 100 parts |
| Negatively chargeable control agent (chromium complex of monoazo dye) | 1.1 part |
| Low-molecular weight polypropylene (Mw = 6000) | 3 parts |

The above components were melt-kneaded by means of a twin-screw extruder heated up to 140° C., and the kneaded product, after cooling, was coarsely crushed by means of a hammer mill, and then finely pulverized by means of a jet mill. The finely pulverized product was classified by means of a wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a negatively chargeable magnetic toner (I) (Tg=57° C.) having a volume-average particle size of 6.4 microns.

| Production Example 2 | |
|---|---|
| Resin composition of Synthesis Example 2 | 100 parts |
| Magnetic fine powder (BET value = 8.6 $m^2/g$) | 110 parts |
| Negatively chargeable control agent (chromium complex of monoazo dye) | 1.1 parts |
| Low-molecular weight polypropylene (Mw = 6000) | 3 parts |

Negatively chargeable magnetic toners (II) and (III) having different average particle sizes as show in Table 1 appearing hereinafter were prepared from the above ingredients otherwise in a similar manner as in Production Example 1.

| Production Example 3 | |
|---|---|
| Resin composition of Synthesis Example 3 | 100 parts |
| Magnetic fine powder (BET value = 8.6 $m^2/g$) | 80 parts |
| Negatively chargeable control agent (chromium complex of monoazo dye) | 1.1 parts |
| Low-molecular weight polypropylene (Mw = 6000) | 3 parts |

A negatively chargeable magnetic toner (IV) was prepared from the above ingredients otherwise in a similar manner as in Production Example 1.

Production Examples 4 and 5

Negatively chargeable magnetic toners (V) and (VI) were prepared by using the resin compositions of Synthesis Examples 4 and 5 in place of the resin composition of Synthesis Example 3 otherwise in a similar manner as in Production Example 1.

| Reference Porduction Example 1 | |
|---|---|
| Resin composition of Reference Synthesis Example 1 | 100 parts |
| Magnetic fine powder (BET value = 7.7 $m^2/g$) | 90 parts |
| Negatively chargeable control agent (chromium complex of salicylic acid) | 1.1 parts |
| Low-molecular weight polypropylene (Mw = 6000) | 3 parts |

A negatively chargeable magnetic toner (VII) (Tg=55° C.) was prepared from the above ingredients otherwise in a similar manner as in Production Example.

The particle size distributions of the above-obtained toners (I)-(VII) are shown in the following Table 1.

TABLE 1

| Toner No. | Toner particle size distribution: Number % of ≦5 μm | Volume % of ≧12.7 μm | Number % of 6.35-10.08 μm | Volume average size (μm) | Number %/Volume % of ≦5 μm |
|---|---|---|---|---|---|
| I | 42.3 | 0 | 24.0 | 6.4 | 2.3 |
| II | 38.1 | 0.6 | 30.5 | 6.9 | 2.9 |
| III | 7.4 | 18.8 | 47.3 | 12.4 | 21.6 |
| IV | 27.5 | 1.1 | 38.0 | 7.8 | 3.4 |
| IV | 30.6 | 0 | 35.5 | 7.0 | 3.0 |
| VI | 31.4 | 0 | 36.2 | 7.2 | 3.1 |
| VIII | 32.6 | 0 | 34.4 | 6.8 | 2.8 |

Examples 1-6 and Comparative Examples 1-3

The above-prepared magnetic toners were blended with silica fine powders shown in Table 2 below by means of a Henschel mixer to prepare developers.

Then, each of the thus prepared developers was charged in an image forming apparatus (LBP-8II, mfd. by Canon K.K.) having a cleaning blade of polyurethane and remodeled to be equipped with a contact charging device as shown in FIG. 1. A DC voltage (−700 V) and an AC voltage (300 Hz, 1500 Vpp) were applied to the contact charging device, and a successive image formation test was performed at a printing rate of 8 sheets (A4) per minute in a reversal development mode under normal temperature - normal humidity conditions (25° C., 60 RH), high temperature - high humidity conditions (30° C., 90%RH) and low temperature - low humidity conditions (15° C., 10%RH), respectively, whereby printed images were evaluated. At the same time, the appearances of the surfaces of the charging member (roller-type) and lamination-type OPC photosensitive drum were observed for evaluation.

The photosensitive drum used was one having a surface abrasion characteristic in terms of an abrasion decrease of $2.5\times10^{-2}$ $cm^3$ by a Taber abraser.

As described above, the charging roller 2 had a diameter of 12 mm and comprised a 5 mm-dia. core metal 2*a* coated with an approx. 3.5 mm-thick electroconductive rubber layer 2*b* and further with a 20 micron-thick releasable film 2*c* of methoxymethylated nylon. The charging roller 2 was pressed against the OPC photosensitive member 1 so as to exert a total pressure of 1.2 kg (linear pressure of 55 g/cm).

The outline of the image forming apparatus is illustrated in FIG. 5. In the apparatus, a toner layer was formed in a thickness of 130 microns on the sleeve 504, and the sleeve 504 was disposed at a minimum spacing of 300 microns from the OPC photosensitive drum 501 and the image formation test was performed under application of a DC bias of −500 V and an AC bias of 1800 Hz and 1600 Vpp to the sleeve.

Figure 7:
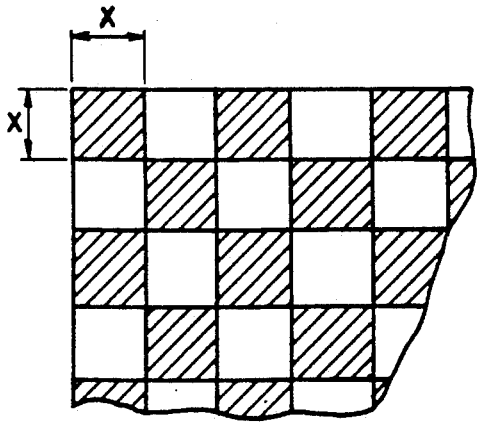
FIG. 7 is an illustration of a checker pattern for evaluating reproducibility of minute dots.

The results of the image forming test are summarized in Table 4 below. In Table 4, the image density represents an average of values measured at 5 points in a 5 mm×5 mm solid black square image. The minute dot reproducibility represents the reproducibility of a checker pattern as shown in FIG. 7 including 100 unit square dots each having one side X measuring 80 microns or 50 microns as shown in FIG. 7, whereby the reproducibility was evaluated by observation through a microscope while noticing the clarity (presence or absence of defects) and scattering to the non-image parts. The toner sticking onto the OPC photosensitive member was evaluated by observing the resultant toner images and the surface state of the OPC photosensitive member after 6,000 sheets of image formation.

Table 2 below summarizes the properties of the hydrophobic silica, Table 3 summarizes the properties of the developers, and Table 4 summarizes the compositions and evaluation results of the developers. The evaluation standards are shown below.

Fog
- ○: Substantially no.
- Δ: Observed but practically acceptable.
- x: Practically unacceptable.

Toner sticking onto photosensitive member
- ○: No sticking at all.
- ○Δ: 1-3 white voids in A4 size solid black image attributable to toner sticking.
- Δ: 4-10 white voids in A4 size solid black image.
- x: More than 10 white voids in A4 size solid black image.

Dot reproducibility
- ○: Less than 2 defects.
- ○Δ: 3-5 defects.
- Δ: 6-10 defects.
- x: 11 or more defects.

TABLE 2

| | Silica: BET value ($m^2/g$) | Triboelectric charge (μC/g) | Hydrophobicity (%) | Treating agent |
|---|---|---|---|---|
| Hydrophobic silica A | 200 | −250 | 98 | Hexamethyldisilazane + Silicone oil |
| Hydrophobic | 200 | −200 | 94 | Silicone oil |

TABLE 2-continued

| | Silica | | | |
|---|---|---|---|---|
| | BET value ($m^2/g$) | Triboelectric charge ($\mu C/g$) | Hydrophobicity (%) | Treating agent |
| Silica B Hydrophobic | 200 | −170 | 93 | Hexamethyldisilazane |
| Silica C | | | | |
| Silica D | 200 | −30 | Totally wettable | None |

TABLE 3

| | | | Developer properties | | |
|---|---|---|---|---|---|
| Example No. | Toner No. | Silica (wt. %) | BET specific surface area ($m^2/g$) | Loose apparent density (g/cm) | True density ($g/cm^3$) |
| Ex. 1 | I | A (1.4) | 3.4 | 0.46 | 1.67 |
| Ex. 2 | II | A (1.0) | 2.6 | 0.51 | 1.72 |
| Ex. 3 | IV | A (1.0) | 2.3 | 0.50 | 1.52 |
| Ex. 4 | IV | B (1.0) | 2.2 | 0.50 | 1.52 |
| Ex. 5 | V | A (1.4) | 3.2 | 0.48 | 1.67 |
| Ex. 6 | VI | A (1.4) | 3.1 | 0.49 | 1.67 |
| Comp. Ex. 1 | II | D (1.0) | 2.5 | 0.46 | 1.72 |
| Comp. Ex. 2 | III | D (0.6) | 1.4 | 0.54 | 1.40 |
| Comp. Ex. 3 | VII | D (1.4) | 3.3 | 0.49 | 1.61 |

TABLE 4

| | Image evaluation | | | |
|---|---|---|---|---|
| Example No. | Image density (initial) | Dot reproducibility x = 80 μ | Dot reproducibility x = 50 μ | Toner sticking (after 6000 sheets) |
| Ex. 1 | 1.4 | ○ | ○ | ○Δ |
| Ex. 2 | 1.4 | ○ | ○ | ○ |
| Ex. 3 | 1.4 | ○ | ○Δ | ○Δ |
| Ex. 4 | 1.4 | ○ | ○Δ | ○Δ |
| Ex. 5 | 1.4 | ○ | ○ | ○Δ |
| Ex. 6 | 1.4 | ○ | ○ | ○Δ |
| Comp. Ex. 1 | 0.6 | Δ | x | x |
| Comp. Ex. 2 | 0.8 | Δ | x | ○ |
| Comp. Ex. 3 | 1.0 | ○ | ○ | x |

| Production Example 6 | |
|---|---|
| Styrene-n-butyl acrylate copolymer (copolymerization weight ratio = 8:2, Mw = 25 × $10^4$) | 100 parts |
| Magnetic fine powder (BET value = 8.6 $m^2/g$) | 60 parts |
| Negatively chargeable control agent (chromium complex of monoazo dye) | 1 part |
| Low-molecular weight polypropylene (Mw = 6000) | 3 parts |

The above components were melt-kneaded by means of a twin-screw extruder heated up to 140° C., and the kneaded product, after cooling, was coarsely crushed by means of a hammer mill, and then finely pulverized by means of a jet mill. The finely pulverized product was classified by means of a wind-force classifier to obtain a negatively chargeable magnetic toner having a volume-average particle size of 12 microns.

| Production Example 7 | |
|---|---|
| Styrene-2-ethylhexyl acrylate copolymer (copolymerization ratio = 8:2, Mw = 20 × $10^4$) | 100 parts |
| Magnetic fine powder (BET value = 8.6 $m^2/g$) | 60 parts |
| Negatively chargeable control agent (salciylic acid-type chromium comples) | 1 part |
| Low-molecular weight polypropylene (Mw = 6000) | 3 parts |

A magnetic toner was prepared from the above ingredients otherwise in a similar manner as in Production Example 6.

The above-prepared magnetic toners were blended with colloidal silica fine powders shown in the following Examples by means of a Henschel mixer to prepare developers containing externally added colloidal silica fine powder.

Example 7

100 parts of colloidal silica fine powder having a specific surface area of 200 $m^2/g$ (Aerosil #200, Nihon Aerosil K.K.) was treated with 20 parts of hexamethyldisilazane (HMDS) and then with 10 parts of dimethylsilicone oil ("KF-96 100 CS", mfd. by Shin-etsu Kagaku K.K.) diluted with a solvent, followed by drying and heating at about 250° C., to obtain hydrophobic colloidal silica fine powder having a hydrophobicity of 99%.

0.6 parts of the hydrophobic colloidal silica fine powder was added to 100 parts of the magnetic toner according to Production Example 6, followed by blending by a Henschel mixer to prepare a developer comprising a magnetic toner and a hydrophobic colloidal silica fine powder added thereto.

The developer was charged in an image forming apparatus ("LBP-SX", mfd. by Canon K.K.) remodeled to be equipped with a contact-charging device (roller) as shown in FIG. 1, which was caused to abut to the OPC photosensitive drum at a pressure of 50 g/cm and supplied with a voltage comprising a DC component (−600 volts) and an AC component (2000 Vpp, 150 Hz). Thus, a successive image formation test of 5000 sheets was performed at a printing rate of 4 sheets (A4) per minute in a reversal development mode under various sets of environmental conditions including normal temperature - normal humidity (25° C., 60%RH), high temperature - high humidity (30° C., 90%RH), and low temperature - low humidity (15° C., 10%RH). The resultant printed images were evaluated and, at the same time, the appearances of the surfaces of the contact-charging member (roller-type) and the OPC photosensitive drum were observed.

As a result, good images free from thick-pale differences in image density were obtained under the respective conditions. Further, the surfaces of the contact-charging member and the photosensitive drum were free from damages or abrasion, or occurrence of sticking of residual developer, whereby good durability or successive image formation characteristic was exhibited.

Example 8

100 parts of colloidal silica fine powder having a specific surface area of 200 $m^2/g$ (Aerosil #200, Nihon Aerosil K.K.) was treated with 10 parts of dimethylsilicone oil ("KF-96 100 CS", mfd. by Shin-etsu Kagaku K.K.) diluted with a solvent, followed by drying and heating at about 250° C., to obtain hydrophobic colloidal silica fine powder having a hydrophobicity of 93%. Then, 0.5 parts of the thus-prepared hydrophobic colloidal silica fine powder was added to 100 parts of the magnetic toner according to Production Example 6, followed by blending by a Henschel mixer to prepare a developer.

The developer was subjected to a successive printing test of 3000 sheets under the respective environmental conditions similarly as in Example 7, whereby there was observed no particular sticking of developer onto the surface of the developer or the photosensitive drum nor was observed any damage or abrasion on the surface of the photosensitive drum, thus showing good durability.

Example 9

100 pats of colloidal silica fine powder having a specific surface area of 130 $m^2/g$ ("Aerosil #130", Nihon Aerosil K.K.) was treated with 3 parts of dimethylsilicone oil ("KF-96 100CS") similarly as in Example 7 to prepare hydrophobic colloidal silica fine powder having a hydrophobicity of 92%. Then, 0.5 part of the thus prepared hydrophobic silica fine powder was added to and blended with 100 parts of the magnetic toner according to Production Example 7 by means of a Henschel mixer to prepare a developer.

The developer was subjected to a successive printing test of 3000 sheets similarly as in Example 7, whereby no sticking of residual developer on the surface of the contact charging member or photosensitive drum was observed.

Example 10

100 pats of colloidal silica fine powder having a specific surface area of 300 $m^2/g$ ("Aerosil #300", Nihon Aerosil K.K.) was treated with 30 parts of olefin-modified silicone oil ("KF-415", mfd. by Shinetsu Kagaku K.K.) similarly as in Example 7 to prepare hydrophobic colloidal silica fine powder having a hydrophobicity of 99%. Then, 0.5 part of the thus prepared hydrophobic silica fine powder was added to and blended with 100 parts of the magnetic toner according to Production Example 7 by means of a Henschel mixer to prepare a developer.

The developer was subjected to a successive printing test of 3000 sheets similarly as in Example 7 except that the contact-charging member was replaced by one of the blade-type shown in FIG. 2, whereby no sticking of residual developer or damage or abrasion on the surface of the contact charging member or photosensitive drum was observed.

Example 11

100 pats of colloidal silica fine powder ("Aerosil #200") was treated with 15 parts of fluorine-modified silicone oil ("FL-100 450 C/S", Shin-etsu Kagaku K.K.) similarly as in Example 7 to prepare hydrophobic colloidal silica fine powder having a hydrophobicity of 95%. Then, 0.8 part of the thus prepared hydrophobic silica fine powder was added to and blended with 100 parts of the magnetic toner according to Production Example 6 by means of a Henschel mixer to prepare a developer.

The developer was subjected to a successive printing test of 3000 sheets under the respective environmental conditions similarly as in Example 7, whereby there was observed no particular sticking of developer onto the surface of the developer or the photosensitive drum nor was observed any damage or abrasion on the surface of the photosensitive drum, thus showing good durability.

Example 12

100 pats of colloidal silica fine powder ("Aerosil #200") was treated with 32 parts of α-methylstyrene-modified silicone oil ("KF-410", Shinetsu Kagaku K.K.) similarly as in Example 7 to prepare hydrophobic colloidal silica fine powder having a hydrophobicity of 94%. Then, 0.6 part of the thus prepared hydrophobic silica fine powder was added to and blended with 100 parts of the magnetic toner according to Production Example 7 by means of a Henschel mixer to prepare a developer.

The developer was subjected to a successive printing test of 3000 sheets similarly as in Example 7, whereby no sticking of residual developer on the surface of the contact charging member or photosensitive drum was observed, but slight contamination with silicone oil was observed on the photosensitive member, which however did not lead to recognizable image irregularities.

Example 13

| | |
|---|---|
| Styrene-n-butyl acrylate copolymer (copolymerization weight ratio = 8:2, Mw = 25 × $10^4$) | 100 parts |
| Magnetic fine powder (BET value = 8.6 $m^2/g$) | 60 parts |
| Positively chargeable control agent (nigrosine dye) | 4 parts |
| Low-molecular weight polypropylene (Mw = 6000) | 3 parts |

The above components were melt-kneaded by means of a twin-screw extruder heated up to 140° C., and the kneaded product, after cooling, was coarsely crushed by means of a hammer mill, and then finely pulverized by means of a jet mill. The finely pulverized product was classified by means of a wind-force classifier to obtain a positively chargeable magnetic toner having a volume-average particle size of 12 microns.

Separately, colloidal silica fine powder (average particle size: 0.16 micron, BET specific surface area: 130 $m^2/g$) was treated with 20 parts of amino-modified silicone oil having an amine value of 700 to obtain a positively chargeable hydrophobic colloidal silica fine powder. Then, 0.5 part of the thus treated colloidal silica fine powder was blended with the above-prepared toner to obtain a positively chargeable developer comprising a positively chargeable toner and a hydrophobic colloidal silica added thereto.

The developer was charged in the image forming apparatus ("FC-5", mfd. by Canon K.K.) remodeled to be equipped with a contact-charging device (roller) as shown in FIG. 1, which was caused to abut to the photosensitive member at a pressure of 50 g/cm and supplied with a voltage comprising a DC component (−500 volts) and an AC component (2000 Vpp, 150 Hz), whereby an image formation test was performed in a normal development mode.

As a result, good images free from defects were obtained under the various sets of conditions of normal temperature - normal humidity (25° C., 60%RH), high temperature high humidity (32.5° C., 85%RH) and low temperature low humidity (15° C., 10%RH), respectively.

Further, a successive image formation test of about 5000 sheets was performed while supplying the toner, whereby good images free from defects were obtained under the respective conditions. There was observed no sticking of developer onto the surface of the developer or the photosensitive drum after the successive copying test nor was observed any damage or abrasion on the surface of the photosensitive drum.

Example 14

A positively chargeable developer was prepared in the same manner as in Example 13 except for using a positively chargeable hydrophobic colloidal silica fine powder obtained by treating 100 parts of the starting colloidal silica fine powder used in Example 13 with 4 parts of the amino-modified silicone oil having an amine value of 700. The developer was subjected to a similar successive image formation test of 3000 sheets as in Example 13.

As a result, good images were obtained-similarly as in Example 13. There was observed no damage or abrasion, or sticking of residual developer on the surface of the charging member or the photosensitive drum after the successive image formation test.

Example 1 5

A positively chargeable developer was prepared in the same manner as in Example 13 except for using a positively chargeable hydrophobic colloidal silica fine powder obtained by treating the starting colloidal silica fine powder with 45 parts of the amino-modified silicone oil. The developer was subjected to a similar successive image formation test of 3000 sheets as in Example 13 except that the charging device was replaced by one of the blade-type shown in FIG. 2. As a result, there there was observed no damage or abrasion, or sticking of residual developer on the surface of the charging member or the photosensitive drum.

Example 16

| | |
|---|---|
| Resin composition of Synthesis Example 6 | 100 parts |
| Magnetic material (average particle size = 0.2 micron) | 60 parts |
| Monoazo-type dye | 2 parts |
| Low-molecular weight poly- | 3 parts |

-continued

| |
|---|
| propylene |

The above components were melt-kneaded by means of a roller mill heated to 150° C., and the kneaded product, after cooling, was coarsely crushed by means of a hammer mill, and then finely pulverized by means of a jet mill. The finely pulverized product was classified by means of a wind-force classifier to obtain a negatively chargeable magnetic toner having a volume-average particle size of 11.8 microns. Then, 100 parts of the thus-prepared magnetic toner was dry-blended with 0.5 part of hydrophobic colloidal silica fine powder to obtain a developer.

The developer was charged in an image forming apparatus ("FC-5", mfd. by Canon; having a 30 mm-dia. OPC lamination type negatively chargeable photosensitive member) remodeled so as to be suitable for reversal development and electrostatic transfer and to be equipped with a contact-charging device as shown in FIG. 1 which was abutted to the OPC photosensitive drum at a pressure of 50 g/cm and supplied with a voltage comprising a DC component (−600 volts) and an AC component (2000 Vpp, 150 Hz), whereby an image formation test was performed under application of DC 600 volts and an AC current of 170 μA so as to charge the photosensitive member to −600 volts.

As a result, even after 3000 sheets of the image formation, good images were continually obtained without causing toner-sticking or damages on the surface of the charging roller or the OPC photosensitive member surface.

Similar tests were conducted under high temperature - high humidity conditions of 32.5° C. and 85%RH and low temperature - low humidity conditions of 15° C. and 10%RH, whereby similarly good results were attained.

Further, even when the image formation was continued up to 5000 sheets while supplying the toner, no problems occurred.

Example 17

A toner having an average particle size of 12.5 microns was prepared similarly as in Example 16.

The toner was charged in an image forming apparatus ("FC-5") remodeled to be equipped with a charging device as shown in FIG. 2 and suitable for reversal development and electrostatic transfer and was subjected to an image formation test in a similar manner as in Example 16, whereby good results were obtained under all the sets of environmental conditions up to 3000 sheets.

Further, when the image formation was continued up to 5000 sheets, slight image defect attributable to toner-sticking onto the photosensitive member and the charging blade was observed from about 4300 sheets under the high temperature - high humidity conditions, but the defect was so slight that it was hardly recognizable on an image and was judged to be practically of no problem.

Example 18

A toner having an average particle size of 11.6 microns was prepared according to the same prescription and production method as in Example 16 except that the resin composition was replaced by one of Synthesis Example 8.

The thus-obtained toner was charged in the remodeled image forming apparatus used in Example 16 and subjected to a similar image formation test as in Example 16, whereby good results were obtained under all the sets of environmental conditions.

Further, the image formation was continued up to 5000 sheets, whereby slight irregularity attributable to a surface damage on the charging roller was observed after 4000 sheets under the low temperature - low humidity conditions but the irregularity was so slight that it was judged to be practically of no problem.

Reference Example 2

A toner having an average particle size of 12.3 microns was prepared according to the same prescription and production method as in Example 16 except that the resin composition was replaced by one of Reference Synthesis Example 2.

The thus-obtained toner was charged in the remodeled image forming apparatus used in Example 16 and subjected to a similar image formation test as in Example 16, whereby no particular problem was observed in the normal environment or the low temperature - low humidity environment, but image defects of white voids attributable to toner-sticking onto the photosensitive member and the charging roller appeared after 1700 sheets in the high temperature - high humidity environment.

Reference Example 3

A toner having an average particle size of 12.4 microns was prepared according to the same prescription and production method as in Example 16 except that the resin composition was replaced by one of Reference Synthesis Example 3.

The thus-obtained toner was charged in the remodeled image forming apparatus used in Example 16 and subjected to a similar image formation test as in Example 16, whereby image defects attributable to charging failure due to damages on the charging roller and the photosensitive member appeared after 1900 sheets under the low temperature - low humidity conditions.

Example 19

| | |
|---|---|
| Magnetic material having a bulk density of 1.10 g/cm$^3$ (Hc = 51 oersted, $\sigma_r$ = 4.5 emu/g) | 60 parts |
| Styrene-n-butyl acrylate copolymer (copolymerization weight ratio = 8:2, Mw = 22 × 10$^4$) | 100 parts |
| Negatively chargeable control agent (chromium comples of monoazo dye) | 1 part |
| Low-molecualr weight polypropylene (Mw = 6000) | 3 parts |

The above components were melt-kneaded by means of a twin-screw extruder heated up to 140° C., and the kneaded product, after cooling, was coarsely crushed by means of a hammer mill, and then finely pulverized by means of a jet mill. The finely pulverized product was classified by means of a wind-force classifier to obtain I negatively chargeable magnetic toner having a volume-average particle size of 12 microns.

Then, 100 parts of the magnetic toner thus obtained was blended with 0.6 part of hydrophobic colloidal silica (hydrophobicity: 92%) to prepare a developer.

The developer was charged in an image forming apparatus ("LBP-8II", by Canon K.K.) remodeled to be equipped with a contact-charging device (roller) as shown in FIG. 1, which was caused to abut to the OPC photosensitive drum at a pressure of 50 g/cm and supplied with a voltage comprising a DC component (−600 volts) and an AC component (2000 Vpp, 150 Hz). Thus, a successive image formation test of 5000 sheets was performed at a printing rate of 4 sheets (A3) per minute in a reversal development mode under various sets of environmental conditions including normal temperature - normal humidity (25° C., 60%RH), high temperature - high humidity (30° C., 90%RH), and low temperature - low humidity (15° C., 10%RH). The resultant printed images were evaluated and, at the same time, the appearances of the surfaces of the contact-charging member (roller-type) and the OPC photosensitive drum were observed.

As a result, under any set of environmental conditions, the surfaces of the charging member and the photosensitive member were almost free from damages or abrasion even after the printing test and further no sticking of residual toner was observed. The resultant image were good ana also excellent in reproducibility of thin lines.

Example 20

| | |
|---|---|
| Magnetic material having a bulk density of 0.67 g/cm$^3$ (Hc = 64 Oe, $\sigma_r$ = 6.1 emu/g) | 60 parts |
| Styrene-n-butyl acrylate copolymer (copolymerization weight ratio = 8:2, Mw = 16 × 10$^4$) | 100 parts |
| Negatively chargeable control agent (salicylic acid-type chromium complex) | 3 parts |
| Low-molecular weight polypropylene (Mw = 6000) | 3 parts |

A developer was prepared from the above mixture otherwise in the same manner as in Example 19 and subjected to a similar successive printing test of 3000 sheets under the various sets of environmental conditions as in Example 19 except that the contact-charging member was replaced by one of the blade-type.

As a result, under any set of environmental conditions, the surfaces of the charging member and the photosensitive member were almost free from damages or abrasion even after the printing test and further no sticking of residual toner was observed. The resultant image were also good.

Example 21

A developer was prepared in the same manner as in Example 19 except that 60 parts of a magnetic material having a bulk density of 0.36 g/cm (Hc=90 Oe, $\sigma_r$=9.2 emu/g) and subjected to a similar successive printing test of 3000 sheets under the various sets of environmental conditions as in Example 19.

As a result, under the high temperature - high humidity conditions, several spots of sticking were recognized on the photosensitive member after the test but no defect was recognized in the images. Also under the other sets of conditions, good images were obtained without irregularities.

What is claimed is:

1. An image forming apparatus, comprising:

a member to be charged for carrying an electrostatic image, a contact-charging means for charging the member to be charged in contact with the member to be charged, and a developing means for developing the electrostatic image carried on the member to be charged, wherein the developing means includes a developer for developing the electrostatic image comprising a toner and hydrophobic inorganic fine powder, wherein said toner comprises a binder resin composition which contains 10–70 wt. % of a THF (tetrahydrofuran)-insoluble content and the remainder of a THF-soluble content including a component with a molecular weight of 10,000 or below on a GPC (gel permeation chromatography) chromatogram of the THF-soluble content constituting 10–50 wt. % of the binder resin.

2. The apparatus according to claim 1, wherein said member to be charged comprises a photosensitive member.

3. The apparatus according to claim 1, wherein said member to be charged comprises a lamination-type OPC organic photoconductor photosensitive member.

4. The apparatus according to claim 1, wherein said contact charging means is abutted to the member to be charged at a pressure of 5–500 g/cm.

5. The apparatus according to claim 1, wherein said hydrophobic inorganic fine powder comprises hydrophobic metal oxide fine powder.

6. The apparatus according to claim 1, wherein said hydrophobic inorganic fine powder comprises hydrophobic silica fine powder.

7. The apparatus according to claim 1, wherein said member to be charged comprises a lamination-type OPC photosensitive member, said contact-charging means is in the form of a roller having an electroconductive rubber layer and a releasable coating, said toner comprises negatively chargeable magnetic toner particles, and said hydrophobic inorganic fine powder comprises hydrophobic silica fine powder treated with silicone oil or silicone varnish.

8. The apparatus according to claim 1, wherein said member to be charged comprises a lamination-type OPC photosensitive member, said contact-charging means is in the form of a roller having an electroconductive rubber layer and a releasable coating, said toner comprises positively chargeable magnetic toner particles, and said hydrophobic inorganic fine powder comprises hydrophobic silica fine powder treated with amino-modified silicone oil or amino-modified silicone varnish.

9. The apparatus according to claim 1, wherein said contact-charging means has a voltage application means for applying an AC voltage or/and a DC voltage.

10. The apparatus according to claim 1, wherein said contact-charging means comprises a voltage application means for applying an AC voltage of 0.5–5 kVpp and 50–300 Hz and a DC voltage (absolute value) of 200–900 V.

11. The apparatus according to claim 1, wherein said developing means comprises a developing sleeve for carrying the developer.

12. The apparatus according to claim 1, wherein said member to be charged comprises a lamination-type OPC photosensitive member and has a cleaning means.

13. The apparatus according to claim 12, wherein said cleaning means comprises a cleaning blade.

14. The apparatus according to claim 7, wherein said electroconductive rubber layer has a thickness of 0.1–10 mm, and said releasable coating has a thickness of 5–30 microns.

15. The apparatus according to claim 7, wherein said electroconductive rubber layer comprises an ethylene-propylene-diene terpolymer, and said releasable coating comprises a nylon resin.

16. The apparatus according to claim 7, wherein said lamination-type OPC photosensitive member is surfaced with a material selected from the group consisting of silicone resins, vinylidene chloride resins, ethylene-vinyl chloride resin, styrene-acrylonitrile resin, styrene-methyl methacrylate resin, styrene resins, polyethylene terephthalate resins and polycarbonate resins.

17. The apparatus according to claim 7, wherein said lamination-type OPC photosensitive member is surfaced with polycarbonate.

18. The apparatus according to claim 1, wherein said binder resin composition comprises a vinyl polymer or copolymer.

19. The apparatus according to claim 1, wherein said binder resin composition comprises a styrene polymer or copolymer.

20. The apparatus according to claim 1, wherein said toner comprises magnetic toner particles and the magnetic toner particles contain a magnetic material having a bulk density of 0.35 g/cm$^3$ or higher.

21. The apparatus according to claim 1, wherein said toner comprises magnetic toner particles and the magnetic toner particles contain a magnetic material having a bulk density of 0.5 g/cm$^3$ or higher.

22. The apparatus according to claim 1, wherein said developer comprises a magnetic toner having a volume-average particle size of 4–8 microns and hydrophobic inorganic fine powder treated with silicone oil or silicone varnish, 100 wt. parts of the developer contains 0.2–2.0 wt. parts of the hydrophobic inorganic fine powder, and the magnetic toner contains a binder resin which comprises 3–20 wt. parts of polymerized units of a monomer having an acid group formed of a carboxyl group or its anhydride per 100 wt. parts of the binder resin and has an acid value of 1–70, and the developer has a BET specific surface area of 1.8–3.5 m$^2$/g, a loose apparent density of 0.4–0.52 g/cm$^3$, and a true density of 1.45–1.8 g/cm$^3$.

23. The apparatus according to claim 22, wherein 0.6–1.6 wt. parts of the hydrophobic inorganic fine powder is contained in 100 wt. parts of the developer.

24. The apparatus according to claim 1 wherein said toner comprises a magnetic toner having a volume-average particle size of 4–8 microns, and a particle size distribution including 17–60% by number of magnetic toner particles of 5 microns or smaller, 5–50% by number of magnetic toner particles of 6.35–10.08 microns and 2.0 volume % or less of magnetic toner particles of 12.7 microns or larger and further satisfies the following equation:

$$N/V = -0.06N + k,$$

wherein N denotes the contents in % by number of the magnetic toner particles of 5 microns or smaller, V denotes the content in % by volume of the magnetic toner particles of 5 microns or smaller, k is a positive number of 4.6–6.7, and N is a positive number of 17–60.

25. The apparatus according to claim 1, wherein said hydrophobic inorganic fine powder has been treated with a silane coupling agent and then with silicon oil, silicone-varnish, amino-modified silicone oil or amino-modified silicone varnish.

26. An apparatus unit, comprising:

a member to be charged for carrying an electrostatic image, a contact-charging means for charging the member to be charged in contact with the member to be charged, and a developing means for developing the electrostatic image carried on the member to be charged, wherein the developing means includes a developer for developing the electrostatic image comprising a toner and hydrophobic inorganic fine powder;

wherein at least one of said contact-charging means and developing means is supported integrally together with said member to be charged to form a single unit, which can be connected to or released from an apparatus body as desired; and wherein said toner comprises a binder resin composition which contains 10–70 wt. % of a THF (tetrahydrofuran)-insoluble content and the remainder of a THF-soluble content including a component with a molecular weight of 10,000 or below on a GPC (gel permeation chromatography) chromatogram of the THF-soluble content constituting 10–50 wt. % of the binder resin.

27. The apparatus unit according to claim 26, wherein said member to be charged comprises a photosensitive member.

28. The apparatus unit according to claim 26, wherein said member to be charged comprises a lamination-type OPC organic photoconductor photosensitive member.

29. The apparatus unit according to claim 26, wherein said contact charging means is abutted to the member to be charged at a pressure of 5–500 g/cm.

30. The apparatus unit according to claim 26, wherein said hydrophobic inorganic fine powder comprises hydrophobic metal oxide fine powder.

31. The apparatus unit according to claim 26, wherein said hydrophobic inorganic fine powder comprises hydrophobic silica fine powder.

32. The apparatus unit according to claim 26, wherein said member to be charged comprises a lamination-type OPC photosensitive member, said contact-charging means is in the form of a roller having an electroconductive rubber layer and a releasable coating, said toner comprises negatively chargeable magnetic toner particles, and said hydrophobic inorganic fine powder comprises hydrophobic silica fine powder treated with silicone oil or silicone varnish.

33. The apparatus unit according to claim 26, wherein said member to be charged comprises a lamination-type OPC photosensitive member, said contact-charging means is in the form of a roller having an electroconductive rubber layer and a releasable coating, said toner comprises positively chargeable magnetic toner particles, and said hydrophobic inorganic fine powder comprises hydrophobic silica fine powder treated with amino-modified silicone oil or amino-modified silicone varnish.

34. The apparatus unit according to claim 26, wherein said contact-charging means has a voltage application means for applying an AC voltage or/and a DC voltage.

35. The apparatus unit according to claim 26, wherein said contact-charging means comprises a voltage application means for applying an AC voltage of 0.5–5 kVpp and 50–300 Hz and a DC voltage (absolute value) of 200–900 V.

36. The apparatus unit according to claim 26, wherein said developing means comprises a developing sleeve for carrying the developer.

37. The apparatus unit according to claim 26, wherein said member to be charged comprises a lamination-type OPC photosensitive member and has a cleaning means.

38. The apparatus unit according to claim 37, wherein said cleaning means comprises a cleaning blade.

39. The apparatus unit according to claim 32, wherein said electroconductive rubber layer has a thickness of 0.1–10 mm, and said releasable coating has a thickness of 5–30 microns.

40. The apparatus unit according to claim 32, wherein said electroconductive rubber layer comprises an ethylene-propylene-diene terpolymer, and said releasable coating comprises a nylon resin.

41. The apparatus unit according to claim 32, wherein said lamination-type OPC photosensitive member is surfaced with a material selected from the group consisting of silicone resins, vinylidene chloride resins, ethylene-vinyl chloride resin, styrene-acrylonitrile resin, styrene-methyl methacrylate resin, styrene resins, polyethylene terephthalate resins and polycarbonate resins.

42. The apparatus unit according to claim 32, wherein said lamination-type OPC photosensitive member is surfaced with polycarbonate.

43. The apparatus unit according to claim 26, wherein said binder resin composition comprises a vinyl polymer or copolymer.

44. The apparatus unit according to claim 26, wherein said binder resin composition comprises a styrene polymer or copolymer.

45. The apparatus unit according to claim 26, wherein said toner comprises magnetic toner particles and the magnetic toner particles contain a magnetic material having a bulk density of 0.35 g/cm$^3$ or higher.

46. The apparatus unit according to claim 26, wherein said toner comprises magnetic toner particles and the magnetic toner particles contain a magnetic material having a bulk density of 0.5 g/cm$^3$ or higher.

47. The apparatus according to claim 26, wherein said developer comprises a magnetic toner having a volume-average particle size of 4–8 microns and hydrophobic inorganic fine powder treated with silicone oil or silicone varnish, 100 wt. parts of the developer contains 0.2–2.0 wt. parts of the hydrophobic inorganic fine powder, and the magnetic toner contains a binder resin which comprises 3–20 wt. parts of polymerized units of a monomer having an acid group formed of a carboxyl group or its anhydride per 100 wt. parts of the binder resin and has an acid value of 1–70, and the developer has a BET specific surface area of 1.8–3.5 m$^2$/g, a loose apparent density of 0.4–0.52 g/cm$^3$, and a true density of 1.45–1.8 g/cm$^3$.

48. The apparatus unit according to claim 47, wherein 0.6–1.6 wt. parts of the hydrophobic inorganic fine powder is contained in 100 wt. parts of the developer.

49. The apparatus unit according to claim 26 wherein said toner comprises a magnetic toner having a volume-average particle size of 4–8 microns, and a particle size distribution including 17–60% by number of magnetic toner particles of 5 microns or smaller, 5–50% by number of magnetic toner particles of 6.35–10.08 microns and 2.0 volume % or less of magnetic toner particles of 12.7 microns or larger and further satisfies the following equation:

$$N/V = -0.05N + k,$$

wherein N denotes the contents in % by number of the magnetic toner particles of 5 microns or smaller, V denotes the content in % by volume of the magnetic toner particles of 5 microns or smaller, k is a positive number of 4.6–6.7, and N is a positive number of 17–60.

50. The apparatus unit according to claim 26 wherein said hydrophobic inorganic fine powder has been treated with a silane coupling agent and then with silicon oil, silicone varnish, amino-modified silicone oil or amino-modified silicone varnish.

51. An facsimile apparatus, comprising: an electrophotographic apparatus and a receiving means for receiving image data from a remote terminal, wherein said electrophotographic apparatus comprises:

a member to be charged for carrying an electrostatic image, a contact-charging means for charging the member to be charged in contact with the member to be charged, and a developing means for developing the electrostatic image carried on the member to be charged, wherein the developing means includes a developer for developing the electrostatic image comprising a toner and hydrophobic inorganic fine powder, wherein said toner comprises a binder resin composition which contains 10–70 wt. % of a THF (tetrahydrofuran)-insoluble content and the remainder of a THF-soluble content including a component with a molecular weight of 10,000 or below on a GPC (gel permeation chromatography) chromatogram of the THF-soluble content constituting 10–50 wt. % of the binder resin.

52. The facsimile apparatus according to claim 51, wherein said member to be charged comprises a photosensitive member.

53. The facsimile apparatus according to claim 51, wherein said member to be charged comprises a lamination-type OPC organic photoconductor photosensitive member.

54. The facsimile apparatus according to claim 51, wherein said contact charging means is abutted to the member to be charged at a pressure of 5–500 g/cm.

55. The facsimile apparatus according to claim 51, wherein said hydrophobic inorganic fine powder comprises hydrophobic metal oxide fine powder.

56. The facsimile apparatus according to claim 51, wherein said hydrophobic inorganic fine powder comprises hydrophobic silica fine powder.

57. The facsimile apparatus according to claim 51, wherein said member to be charged comprises a lamination-type OPC photosensitive member, said contact-charging means is in the form of a roller having an electroconductive rubber layer and a releasable coating, said toner comprises negatively chargeable magnetic toner particles, and said hydrophobic inorganic fine powder comprises hydrophobic silica fine powder treated with silicone oil or silicone varnish.

58. The facsimile apparatus according to claim 51, wherein said member to be charged comprises a lamination-type OPC photosensitive member, said contact-charging means is in the form of a roller having an electroconductive rubber layer and a releasable coating, said toner comprises positively chargeable magnetic toner particles, and said hydrophobic inorganic fine powder comprises hydrophobic silica fine powder treated with amino-modified silicone oil or amino-modified silicone varnish.

59. The facsimile apparatus according to claim 51, wherein said contact-charging means has a voltage application means for applying an AC voltage or/and a DC voltage.

60. The facsimile apparatus according to claim 51, wherein said contact-charging means comprises a voltage application means for applying an AC voltage of 0.5–5 kVpp and 50–300 Hz and a DC voltage absolute value of 200–900 V.

61. The facsimile apparatus according to claim 51, wherein said developing means comprises a developing sleeve for carrying the developer.

62. The facsimile apparatus according to claim 51, wherein said member to be charged comprises a lamination-type OPC photosensitive member and has a cleaning means.

63. The facsimile apparatus according to claim 62, wherein said cleaning means comprises a cleaning blade.

64. The facsimile apparatus according to claim 57, wherein said electroconductive rubber layer has a thickness of 0.1–10 mm, and said releasable coating has a thickness of 5–30 microns.

65. The facsimile apparatus according to claim 57, wherein said electroconductive rubber layer comprises an ethylene-propylene-diene terpolymer, and said releasable coating comprises a nylon resin.

66. The facsimile apparatus according to claim 57, wherein said lamination-type OPC photosensitive member is surfaced with a material selected from the group consisting of silicone resins, vinylidene chloride resins, ethylene-vinyl chloride resin, styrene-acrylonitrile resin, styrene-methyl methacrylate resin, styrene resins, polyethylene terephthalate resins and polycarbonate resins.

67. The facsimile apparatus according to claim 57, wherein said lamination-type OPC photosensitive member is surfaced with polycarbonate.

68. The facsimile apparatus according to claim 51, wherein said binder resin composition comprises a vinyl polymer or copolymer.

69. The facsimile apparatus according to claim 51, wherein said binder resin composition comprises a styrene polymer or copolymer.

70. The facsimile apparatus according to claim 51, wherein said toner comprises magnetic toner particles and the magnetic toner particles contain a magnetic material having a bulk density of 0.5 g/cm$^3$ or higher.

71. The facsimile apparatus according to claim 51, wherein said toner comprises magnetic toner particles and the magnetic toner particles contain a magnetic material having a bulk density of 0.35 g/cm$^3$ or higher.

72. The facsimile apparatus according to claim 51, wherein said developer comprises a magnetic toner having a volume-average particle size of 4–8 microns and hydrophobic inorganic fine powder treated with silicone oil or silicone varnish, 100 wt. parts of the developer contains 0.2–2.0 wt. parts of the hydrophobic inorganic fine powder, and the magnetic toner contains a binder resin which comprises 3– 20 wt. parts of polymerized units of a monomer having an acid group formed of a carboxyl group or its anhydride per 100 wt. parts of the binder resin and has an acid value of 1–70, and the developer has a BET specific surface area of 1.8–3.5 $m^2/g$, a loose apparent density of 0.4–0.52 $g/cm^3$, and a true density of 1.45–1.8 $g/cm^3$.

73. The facsimile apparatus according to claim 72, wherein 0.6–1.6 wt. parts of the hydrophobic inorganic fine powder is contained in 100 wt. parts of the developer.

74. The facsimile apparatus according to claim 51, wherein said toner comprises a magnetic toner having a volume-average particle size of 4–8 microns, and a particle size distribution including 17–60% by number of magnetic toner particles of 5 microns or smaller, 5–50% by number of magnetic toner particles of 6.35–10.08 microns and 2.0 volume % or less of magnetic toner particles of 12.7 microns or larger and further satisfies the following equation:

$$N/V = -0.05N + k.$$

wherein N denotes the contents in % by number of the magnetic toner particles of 5 microns or smaller, V denotes the content in % by volume of the magnetic toner particles of 5 microns or smaller, k is a positive number of 4.6–6.7, and N is a positive number of 17–60.

75. The facsimile apparatus according to claim 51, wherein said hydrophobic inorganic fine powder has been treated with a silane coupling agent and then with silicon oil, silicone varnish, amino-modified silicone oil or amino-modified silicone varnish.

* * * * *

UNITED STATES PATENT AND TRADEMARK OFFICE

CERTIFICATE OF CORRECTION

PATENT NO. : 5,307,122

DATED : April 26, 1994

INVENTOR(S) : MANABU OHNO, ET AL.

It is certified that error appears in the above-indentified patent and that said Letters Patent is hereby corrected as shown below:

On the title page, item [54] and column 1, line 2, "APPARATUS" (first occurrence) should read --APPARATUS,-- and "UNIT" should read UNIT,--.

COLUMN 7

Line 46, "2.0" should read --2.0%--.

COLUMN 10

Line 1, "remanenace" should read --remanence--.
Line 8, ""ferrus" should read --ferrous--.

COLUMN 12

Line 30, "p-n-onylstyrene," should read --p-n-nonylstyrene,--.

COLUMN 13

Line 5, "for the acrylate groups" (second occurrence) should be deleted.

COLUMN 14

Line 13, "70 wt." should read --70 wt. %--.

COLUMN 16

Line 15, "dropwised" should read --dropwise--.

UNITED STATES PATENT AND TRADEMARK OFFICE

CERTIFICATE OF CORRECTION

PATENT NO. : 5,307,122

DATED : April 26, 1994

INVENTOR(S) : MANABU OHNO, ET AL.

It is certified that error appears in the above-identified patent and that said Letters Patent is hereby corrected as shown below:

COLUMN 23

Line 47, "received" should read --received from--.

COLUMN 26

Line 12, "15. parts" should read --15 parts--.
Line 35, "28 wt." should read --28 wt. %--.
Line 46, "0.1 wt." should read --0.1 wt. %)--.
Line 64, "43 wt." should read --43 wt. %--.

COLUMN 27

Line 30, "15. parts" should read --15 parts--.
Line 40, "17 wt." should read --17 wt. %--.
Line 43, "Synthesis Example 2" should read --Reference Synthesis Example 2--.
Line 51, "56 wt." should read --56 wt. %.--.

COLUMN 28

Line 5, "7 wt." should read --7 wt. %--.
Line 25, "power" should read --powder--.
Line 45, "show" should read --shown--.

COLUMN 29

TABLE 1, "IV" (second occurrence) should read --V--.
Line 47, "60 RH)" should read --60% RH)--.

UNITED STATES PATENT AND TRADEMARK OFFICE

CERTIFICATE OF CORRECTION

PATENT NO. : 5,307,122

DATED : April 26, 1994

INVENTOR(S) : MANABU OHNO, ET AL.

It is certified that error appears in the above-identified patent and that said Letters Patent is hereby corrected as shown below:

COLUMN 32

Line 29, "(salciylic" should read --(salicylic--.
Line 30, "comples)" should read --complex)--.

COLUMN 33

Line 39, "pats" should read --parts--.
Line 56, "pats" should read --parts--.

COLUMN 34

Line 8, "pats" should read --parts--.
Line 27, "pats" should read --parts--.

COLUMN 35

Line 47, "Example 1 5" should read --Example 15--.
Line 57, "there" should be deleted.

COLUMN 36

Line 27, "DC 600" should read --DC-600--.

COLUMN 37

Line 62, "I" should read --a--.

COLUMN 38

Line 22, "ana" should read --and--.
Line 48, "image" should read --images--.

UNITED STATES PATENT AND TRADEMARK OFFICE

CERTIFICATE OF CORRECTION

PATENT NO. : 5,307,122

DATED : April 26, 1994

INVENTOR(S) : MANABU OHNO, ET AL.

It is certified that error appears in the above-identified patent and that said Letters Patent is hereby corrected as shown below:

COLUMN 38

Line 54, "0.36 g/cm" should read --0.36 g/cm$^3$--.
Line 62, "Also" should read --Also,--.

COLUMN 40

Line 60, "N/V=-0.06N+k," should read --N/V=-0.05N+k,--.

Signed and Sealed this

Twenty-seventh Day of December, 1994

*Attest:*

Bruce Lehman

BRUCE LEHMAN

*Attesting Officer*

*Commissioner of Patents and Trademarks*